US011613883B2

(12) United States Patent
Bernoti

(10) Patent No.: US 11,613,883 B2
(45) Date of Patent: Mar. 28, 2023

(54) DRAINS AND METHODS FOR PROVIDING A CENTERED DRAIN OPENING WITHOUT MOVING A DRAIN OUTLET

(71) Applicant: Carlos Bernoti, Pompano Beach, FL (US)

(72) Inventor: Carlos Bernoti, Pompano Beach, FL (US)

( * ) Notice: Subject to any disclaimer, the term of this patent is extended or adjusted under 35 U.S.C. 154(b) by 557 days.

(21) Appl. No.: 16/239,901

(22) Filed: Jan. 4, 2019

(65) Prior Publication Data

US 2019/0211540 A1 Jul. 11, 2019

Related U.S. Application Data

(60) Provisional application No. 62/614,812, filed on Jan. 8, 2018.

(51) Int. Cl.
*E03F 5/04* (2006.01)

(52) U.S. Cl.
CPC ..... *E03F 5/0407* (2013.01); *E03F 5/0408* (2013.01); *E03F 2005/0415* (2013.01)

(58) Field of Classification Search
None
See application file for complete search history.

(56) References Cited

U.S. PATENT DOCUMENTS 831,429 A * 9/1906 Harrington ..... F16L 41/02 126/82
3,420,552 A 1/1969 Mork
3,457,568 A 7/1969 Amatruda
3,593,347 A * 7/1971 Nemiroff ..... E03C 1/22 4/DIG. 9
4,014,053 A * 3/1977 Jones ..... E03D 11/16 4/252.5
5,124,031 A * 6/1992 Dallmer ..... E03F 5/0407 210/232
5,309,579 A * 5/1994 Nelson ..... E03D 11/16 285/46
5,653,631 A * 8/1997 Andersen ..... F24F 13/0209 454/339
6,886,190 B2 * 5/2005 Tompane ..... E03F 5/06 4/612
8,474,068 B2 7/2013 Kik, Sr. et al.
8,474,069 B1 7/2013 Whitinger
8,833,387 B2 9/2014 Lucas et al.
8,869,321 B2 10/2014 Donnelly et al.
(Continued)

*Primary Examiner* — Robert J Popovics
(74) *Attorney, Agent, or Firm* — Derek Fahey, Esq.; The Plus IP Firm, PLLC

(57) ABSTRACT

A linear drain for providing a centered drain opening without moving a drain outlet is disclosed. The linear drain includes an ingress assembly defining at least one ingress opening. An egress assembly defines a channel configured to covey liquid to an egress opening. The egress opening is offset from a channel midpoint of the channel and is configured to be in communication with the drain outlet. An attaching element connects the ingress assembly with the egress assembly. The attaching element is configured such that an ingress assembly midpoint of the ingress assembly is configured to be positioned in a plurality of different final locations relative to the egress opening when the centered drain is in a fully assembled configuration.

3 Claims, 18 Drawing Sheets

(56) References Cited

U.S. PATENT DOCUMENTS

| | | | | |
|---|---|---|---|---|
| 8,967,190 | B2 * | 3/2015 | Keizers | E03F 5/0407 137/362 |
| 9,009,880 | B2 | 4/2015 | Wedi | |
| 9,127,446 | B2 * | 9/2015 | Schlueter | E03F 5/04 |
| 9,382,701 | B2 | 7/2016 | Meyers | |
| 9,567,738 | B2 * | 2/2017 | Schlueter | E03F 5/04 |
| 9,567,739 | B2 | 2/2017 | Nyce | |
| 9,611,634 | B2 | 4/2017 | Erlebach | |
| 9,617,723 | B2 | 4/2017 | Stonecipher et al. | |
| 9,739,045 | B1 | 8/2017 | Jones | |
| 10,400,435 | B2 * | 9/2019 | Nivelles | E03F 5/0407 |
| 10,920,410 | B2 * | 2/2021 | Wadaga | E03F 5/0407 |
| 2009/0320204 | A1 | 12/2009 | Wiseman et al. | |
| 2010/0043136 | A1 | 2/2010 | Michael | |
| 2011/0023978 | A1 * | 2/2011 | Keizers | E03F 5/0407 137/362 |
| 2011/0047695 | A1 | 3/2011 | Niedens | |
| 2011/0126350 | A1 | 6/2011 | Wedi | |
| 2012/0079652 | A1 | 4/2012 | Lemire et al. | |
| 2013/0276226 | A1 | 10/2013 | Cook et al. | |
| 2016/0194861 | A1 * | 7/2016 | Nivelles | E03F 5/0407 285/42 |
| 2016/0265203 | A1 * | 9/2016 | Knapp | E03F 5/0408 |
| 2019/0169831 | A1 * | 6/2019 | Wadaga | E03F 5/0409 |
| 2019/0211540 | A1 * | 7/2019 | Bernoti | E03F 5/0407 |

* cited by examiner

DRAINS AND METHODS FOR PROVIDING A CENTERED DRAIN OPENING WITHOUT MOVING A DRAIN OUTLET

CROSS-REFERENCE TO RELATED APPLICATIONS

This patent application claims priority to provisional patent application No. 62/614,812 filed Jan. 8, 2018 and titled "DRAIN WITH SLOTTED PLATE." The subject matter of said provisional application is hereby incorporated by reference in its entirety.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

TECHNICAL FIELD

The present invention relates to the field of drains, and more specifically to the field of linear drains and the installation of linear drains.

BACKGROUND

Drains are used throughout the world. Linear drains are one type of drain. Linear drains, also known as line drains, or trench drains, are becoming more and more popular, because they open possibilities for tile that are not available with a regular point drain. A linear drain typically has an elongated rectilinear form for water egress (exit) that maximizes capturing the flow of water towards a single exit port to deliver the most efficient removal of liquid from the shower basin. It is the new trend in decorative plumbing but the idea has been around for some time in institutional and industrial application. Linear drains are part of a plumbing system and are used to allow water to flow from areas such as showers and baths to the remainder of the plumbing system. In many areas of the world, drains and linear drains are being used not only for their functionality, but also for aesthetic purposes. Additionally, in many areas of the world people are doing their best to make drains an aesthetically pleasing part of a plumbing system, especially in more luxurious locations.

Many times, in showers or other areas, the floor is covered with tile or flooring and drains are installed to move water from the top surface of the flooring to the plumbing system without damaging the remainder of the flooring. In some cases, the drain pipe, outlet, or conduit that leads to the remainder of the plumbing system from the drain is an undesirable location. In many cases an undesirable location of a pipe or outlet can mean that the drain will be off-center or awkwardly placed, which will lead to and aesthetically undesirable floor or room. In more luxurious locations this can be a major problem.

In the past, to solve the problem of having the drain pipe or outlet leading to the remainder of the plumbing system in an undesirable location, additional conduits or adapters would have to be used to position the pipe that would attach to the drain in a more suitable location so that the drain could be placed in a more aesthetically pleasing location. However, the use of additional pipes or adapters to relocate drains creates an additional cost for labor and parts.

As a result, there exists a need for improvements over the prior art and more particularly, for a better drain to provide more aesthetically pleasing flooring areas and an easier way to position drains and drain openings in a more desirable location.

SUMMARY

A linear drain for providing a centered drain opening without moving a drain outlet is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a linear drain for providing a centered drain opening without moving a drain outlet is disclosed. The linear drain includes an ingress assembly defining at least one ingress opening. An egress assembly defines a channel configured to covey liquid to an egress opening. The egress opening is offset from a channel midpoint of the channel and is configured to be in communication with the drain outlet. An attaching element connects the ingress assembly with the egress assembly. The attaching element is configured such that an ingress assembly midpoint of the ingress assembly is configured to be positioned in a plurality of different final locations relative to the egress opening when the centered drain is in a fully assembled configuration.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

In one embodiment, the attaching element further includes at least one track element on at least one of the ingress assembly and the egress assembly. At least one receiving element on at least one of the ingress assembly and the egress assembly. A fastener for attaching the track element to the receiving element.

BRIEF DESCRIPTION OF THE DRAWINGS

The accompanying drawings, which are incorporated in and constitute part of this specification, illustrate embodiments of the invention and together with the description, explain the principles of the disclosed embodiments. The embodiments illustrated herein are presently preferred, it being understood, however, that the invention is not limited to the precise arrangements and instrumentalities shown, wherein.

DETAILED DESCRIPTION

Figure 1:
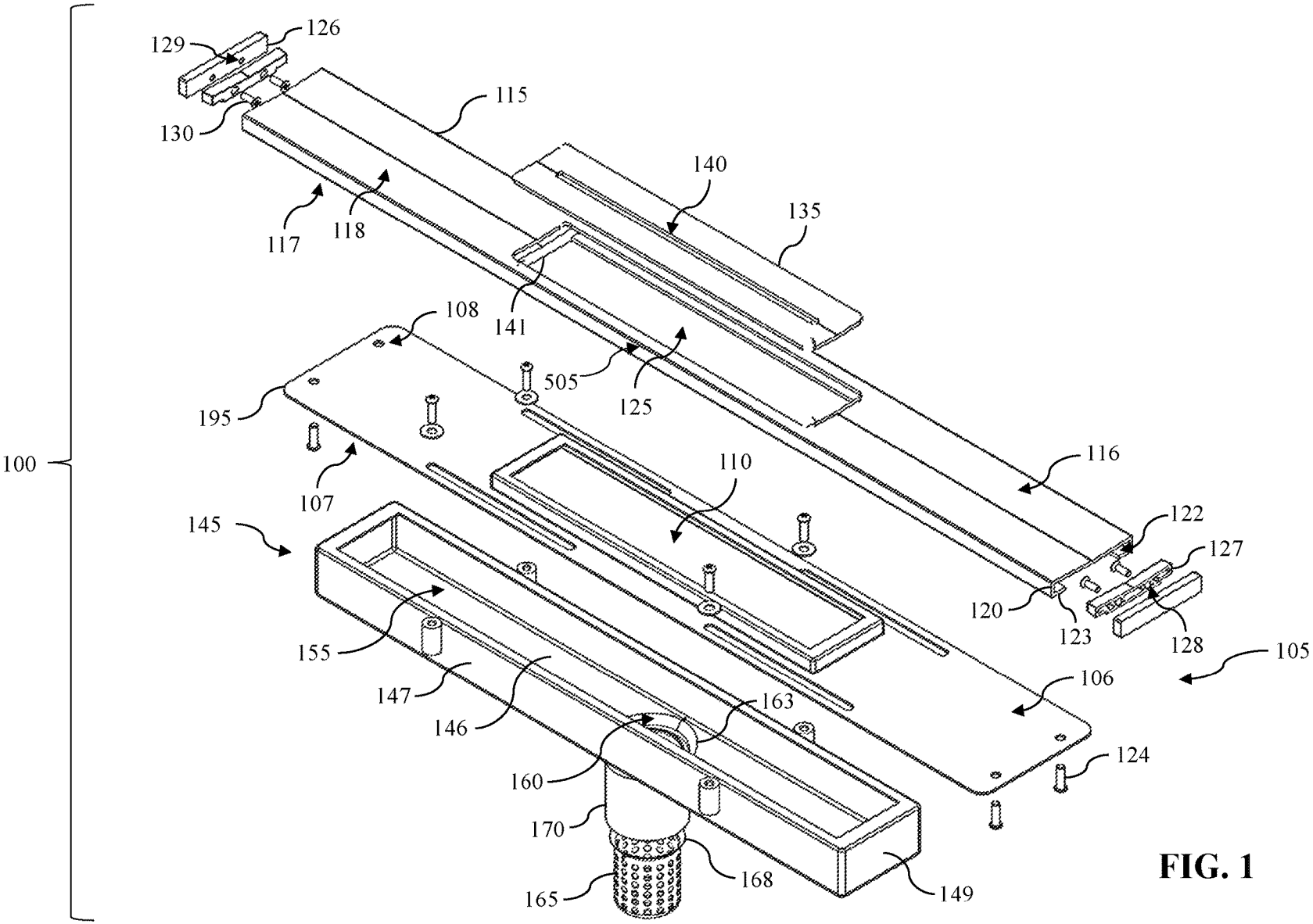
FIG. 1 is an exploded top perspective view of a linear drain according to an example embodiment of the present invention.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions or modifications may be made to the elements illustrated in the drawings, and the methods described herein may be modified by substituting reordering, or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing a linear drain that allows the opening of the drain, or ingress, that receives water from the floor to be positioned at a plurality of different locations relative to the section that allows fluid to exit the drain, or egress. The present embodiment improves over the prior art by providing an ingress assembly having a midpoint that is configured to be positioned in a plurality of different final locations relative to the egress opening when the centered drain is in a fully assembled configuration. Additionally, the disclosed embodiments improve over the prior art by providing an ingress assembly midpoint that is offset from the ingress assembly midpoint. The offset increases the amount of different positions that the ingress opening can be positioned relative to the egress opening. The linear drain improves over the prior art by providing an easier way to deal with drain pipes or outlets that lead to the remainder of the plumbing system in undesirable locations, which makes it easier and more efficient for the installation of aesthetically pleasing drains and plumbing systems. The linear drain improves on the prior art by providing a linear drain it makes it easier and to install linear drains.

Figure 2A:
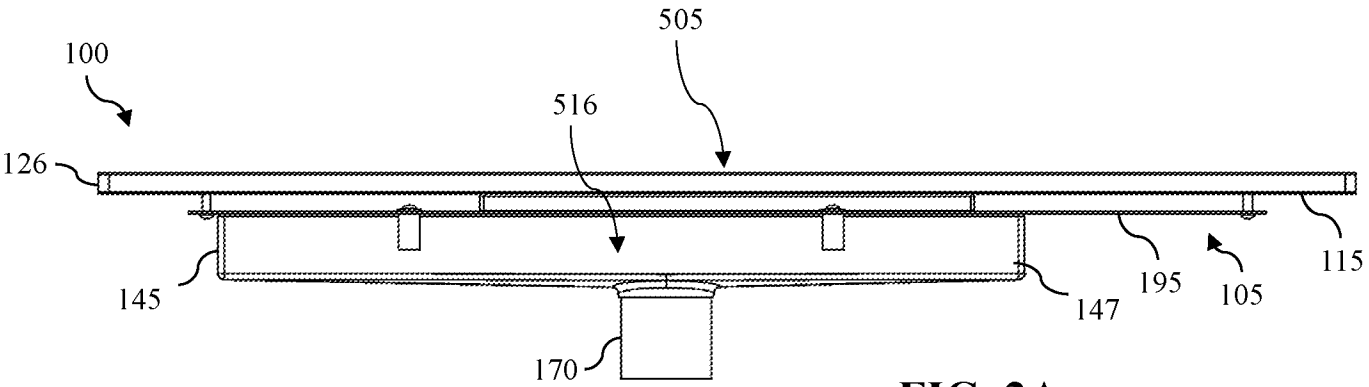
FIG. 2A is a front view of a linear drain, in a fully assembled configuration, according to an example embodiment of the present invention.
Figure 2B:
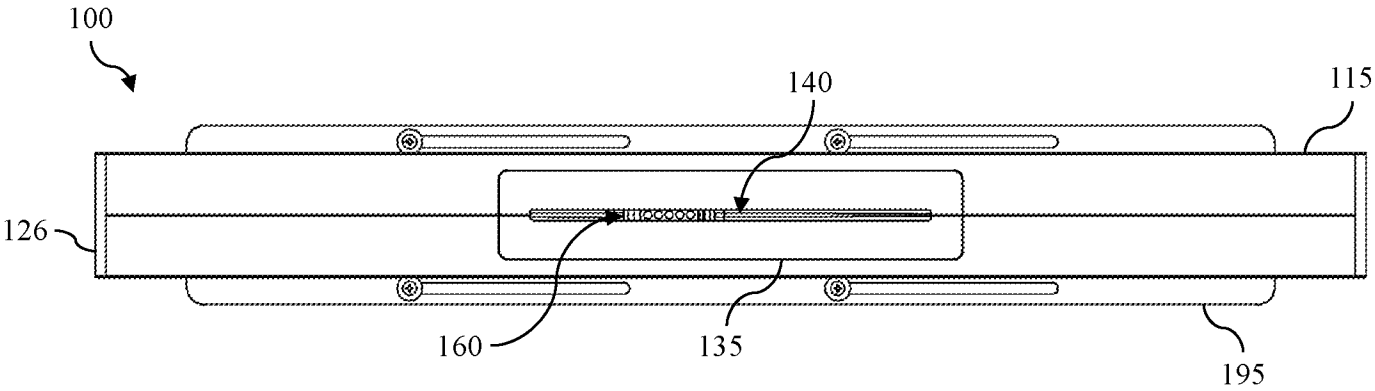
FIG. 2B is a top view of a linear drain, in a fully assembled configuration, according to an example embodiment of the present invention.
Figure 2C:
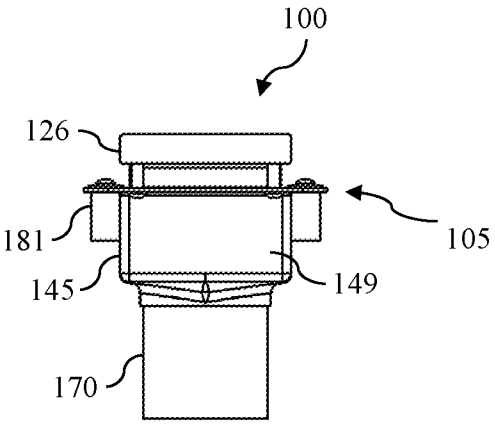
FIG. 2C is a side view of a linear drain, in a fully assembled configuration, according to an example embodiment of the present invention.

Referring now to the Figures, FIGS. 1 and 2A-2C illustrate a linear drain for providing a centered drain opening without moving a drain outlet according to an example embodiment of the present invention. FIG. 1 is an exploded top perspective view of a linear drain, and FIGS. 2A, 2B, and 2C are front, top and side views, respectively, of the fully assembled linear drain. The term centered drain means a drain that is aesthetically pleasing or positioned in a location that user desires the drain to be placed. The term centered drain opening means the opening or openings of the drain is or are positioned to provide a centered drain. Many times, people do not have a centered drain or centered drain opening because the drain outlet is in an incorrect location or location, which requires an operator to use adapters and other devices to position the drain to have a centered drain or centered drain opening.

The linear drain 100 has an ingress assembly 105 defining at least one ingress opening that allows water to move through the ingress assembly. The linear drain also includes an egress assembly 145 defining a channel that is configured to covey liquid to an egress opening 160, wherein the egress opening is offset from a midpoint of the channel. The midpoint of the channel is the location that is equidistant from the ends of channel. The egress opening is configured to be in communication with the drain outlet 170. The drain includes an attaching element for connecting the ingress assembly 105 with the egress assembly 145. The attaching element is configured such that an ingress assembly midpoint of the ingress assembly is configured to be positioned in a plurality of different final locations relative to the egress opening when the linear drain is in a fully assembled configuration to create a centered drain.

In one embodiment, the linear drain 100 comprises an ingress assembly 105 having a first part 195 and a second part 115. In one embodiment, the first part 195 of the ingress assembly includes at least one ingress opening 110. In the present embodiment, first part of the ingress assembly has a substantially planar rectangular shaped body with rounded corners comprising an upward facing side 106 and a downward facing side 107, however, it should be appreciated that the ingress assembly can have other shapes and dimensions, and such variations are within the spirit and scope of the claimed invention. The first part of the ingress assembly may be comprised of materials such as galvanized steel or iron, copper, polybutylene, unplasticized polyvinylchloride (PVC), chlorinated polyvinylchloride (CPVC) and polyethylene (PE) to increase corrosion resistance to specific environments, enhance oxidation resistance, and impart special characteristics.

Each corner of the first part of the ingress assembly may include a plurality of circular holes 108 formed therethrough for receiving fasteners to attach the upward facing side of the first part of the ingress assembly to the downward facing side of a second part 115 of the ingress assembly, as described more fully below.

It should be appreciated that the holes on the first part of the ingress assembly can have a variety of cross-sectional shapes and configurations, and such variations are within the spirit and scope of the claimed invention. The holes on the first part of the ingress assembly can be manufactured from a variety of different processes such as punching, stamping, scissoring, flame cutting, laser cutting, sawing, drilling, milling, or turning. It should also be appreciated that other attachment devices can be used to secure the upward facing side of the first part of the ingress assembly to the downward facing side of the second part of the ingress assembly including screws, bolts, welds, pins, clamps, brackets, magnets, male-female interference-type connections, cable ties, waterproof adhesives, or any other suitable method known in the art.

At least one ingress opening 110 is located on a first part 195 of the ingress assembly 105. In the present embodiment, the ingress opening is located on the center of the first part of the ingress assembly and comprises an elongated rectangular-shaped opening having a predetermined length and width such that fluid flows through the ingress opening and into the egress assembly channel, as described more fully below. It should be appreciated that the ingress opening can have other shapes and dimensions, and such variations are within the spirit and scope of the claimed invention. The ingress opening can be manufactured from a variety of different processes such as punching, stamping, scissoring, flame cutting, laser cutting, sawing, drilling, milling, or turning.

Figure 3:
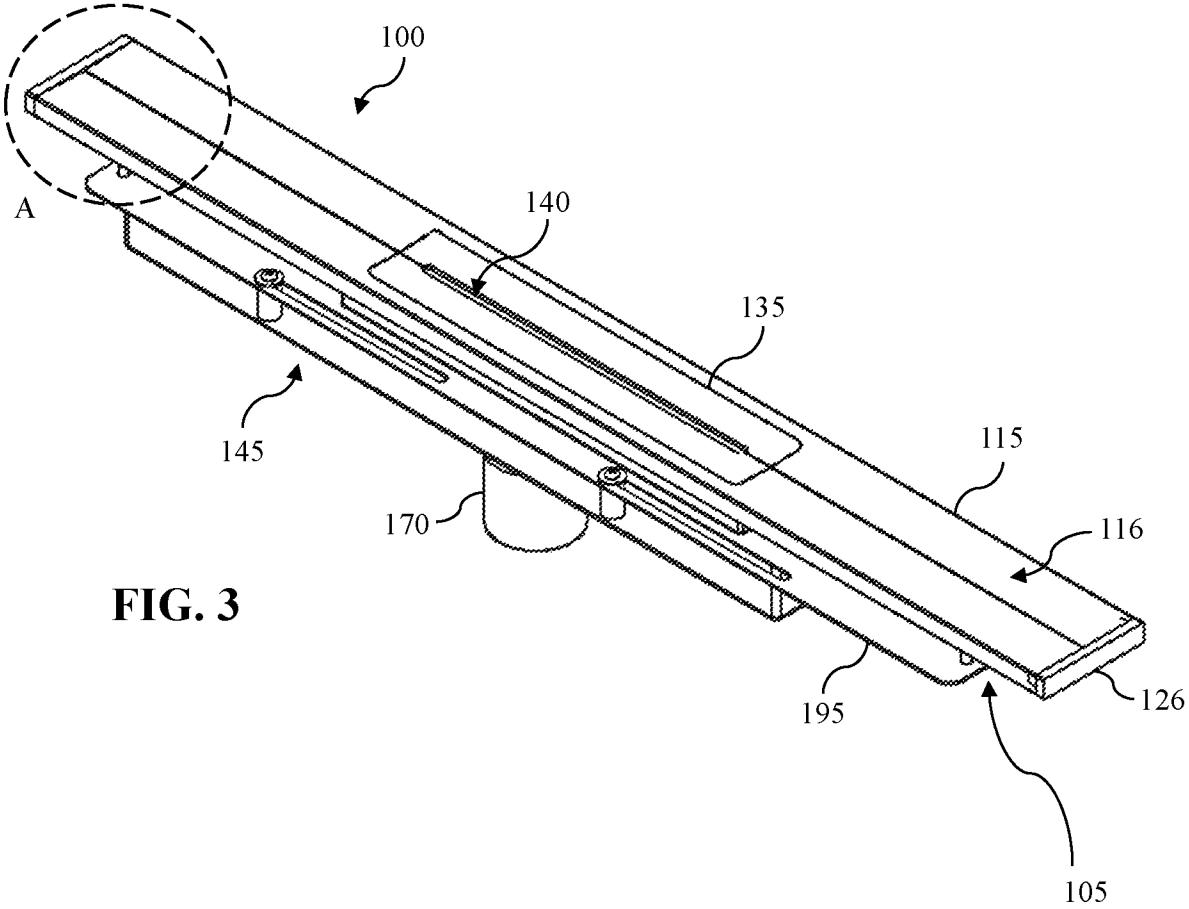
FIG. 3 is a top perspective view of a fully assembled linear drain, in a fully assembled configuration, according to an example embodiment of the present invention.
Figure 4:
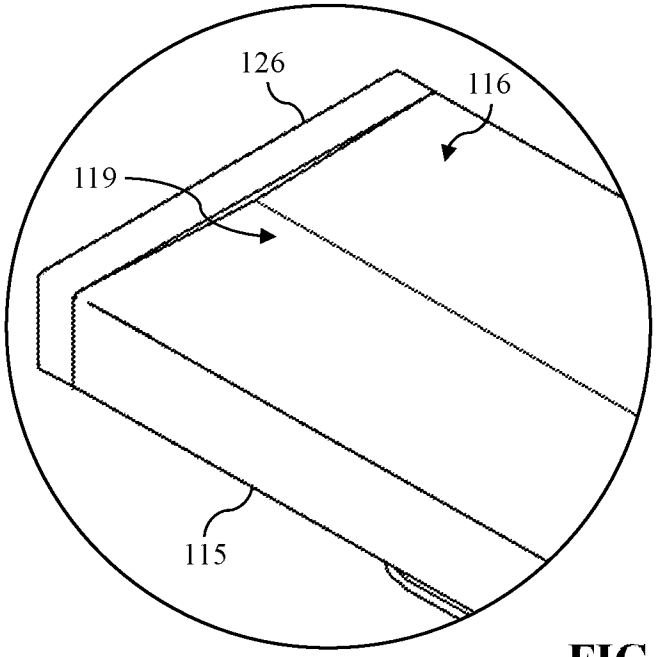
FIG. 4 is a magnified top perspective view of a portion of the area enclosed within circle A of FIG. 3 according to an example embodiment of the present invention.

The ingress assembly further defines further defines a second part 115 having at least one second part opening 125. In the present embodiment, the second part of the ingress assembly has an elongated rectangular shaped body comprising an upward facing side 116 and a downward facing side 117. The upward facing side of the second part has a substantially planar surface 118 to convey fluid toward at least one ingress opening. The downward facing side of the second part of the ingress assembly is configured to attach to the upward facing side of the first part of ingress assembly such that at least one second part opening aligns with at least one ingress opening such that fluid flows into the egress assembly channel, as described more fully below. In another embodiment, as illustrated in FIGS. 3 and 4, the upward facing side of the second part has a sloped surface 119 configured to convey fluid toward at least one ingress opening. It should be appreciated that the second part can have other dimensions and such variations are within the spirit and scope of the claimed invention. The second part of the ingress assembly may be comprised of materials such as galvanized steel or iron, copper, polybutylene, unplasticized polyvinylchloride (PVC), chlorinated polyvinylchloride (CPVC) and polyethylene (PE) to increase corrosion resistance to specific environments, enhance oxidation resistance, and impart special characteristics.

The second part may also include a pair of vertical members 120 on the downward facing side of the second part define a continuous channel 122. The generally planar vertical members span the entire length of the second part in a substantially parallel relationship to one another and define the substantially rectangular cross-sectional shape of the channel. It should be appreciated that the second part can have other cross-sectional shapes, and such variations are within the spirit and scope of the claimed invention.

A pair of horizontal members 123 protrude from the distal ends of the vertical members to define a ninety degree, or right angle. The generally planar horizontal members span the entire length of the second part of the ingress assembly and include a plurality of regularly spaced circular holes (not shown) formed therethrough for receiving fasteners 124 to attach to holes along the upward facing side of the first part of ingress assembly to the downward facing side of the second part of the ingress assembly. In the present embodiment the fastener may be a threaded bolt, screw, nut, washer etc. It should be appreciated that the holes on the horizontal members can have a variety of cross-sectional shapes and configurations, and such variations are within the spirit and scope of the claimed invention. The holes on the horizontal members can be manufactured from a variety of different processes such as punching, stamping, scissoring, flame cutting, laser cutting, sawing, drilling, milling, or turning. It should also be appreciated that other attachment devices can be used to secure the upward facing side of the ingress assembly to the downward facing side of the second part including screws, bolts, welds, pins, clamps, brackets, magnets, male-female interference-type connections, cable ties, waterproof adhesives, or any other suitable method known in the art.

At least one second part opening 125 is located on the second part of the ingress assembly. In the present embodiment, the second part opening is located on the center of the second part and comprises an elongated rectangular-shaped opening having a predetermined length and width such that fluid flows through the second part opening and into the egress assembly channel, as described more fully below. It should be appreciated that the second part opening can have other shapes and such variations are within the spirit and scope of the claimed invention. The second part opening can be manufactured from a variety of different processes such as punching, stamping, scissoring, flame cutting, laser cutting, sawing, drilling, milling, or turning.

Both ends of the second part may be sealed by an end cap 126. The end cap is configured to provide additional support and rigidity to the second part. In the present embodiment, the end caps have a generally planar rectangular shaped body and are secured to the ends of the second part using a friction fit mechanism. It is understood that the end caps may be held in place using any other suitable method known in the art, including snap fits and tabs, screws, adhesives, and clips. The end caps may be formed from the same material as the second part, or they may be formed from any other suitable material.

A gasket 127 is disposed between the end cap and the channel of the second part to prevent fluid from leaking out of the ends of the second part. In the present embodiment, the outermost diameter of the gasket is sized and shaped according to the inner diameter of the second part to be press fit into the channel 122. The gasket includes a plurality of circular holes 128 formed therethrough that are coaxial with the plurality of circular holes of the end cap 129 for receiving fasteners 130 to attach the gasket to the end cap. The gasket may be comprised of rubber materials such as silicone, neoprene, nitrile, and urethanes. The gasket can be manufactured from a variety of different processes such as injection molding, compression molding, and transfer molding.

A grating 135 is configured to cover at least one second part opening such that fluid may still flow into the second part of the central opening. In the present embodiment, the grating has a rectangular shaped body and comprises an elongated rectangular-shaped opening 140 having a predetermined length and width such that fluid flows through the opening and into the egress assembly channel, as described more fully below. It should be appreciated that the grating opening can have other shapes and sizes, and such variations are within the spirit and scope of the claimed invention. The outermost diameter of the grating is sized and shaped according to the inner diameter of the second part opening. The grating fits into the second part opening and rests on top of the perimetric flange 141 located around the inside of the second part opening. The diameter defined by the perimetric flange is smaller than the diameter of the second part opening to prevent the grating from falling through the second part opening. The perimetric flange is offset a certain distance from the upward facing surface of the second part such that when the grating is placed on the perimetric flange, the upward facing surface of the grating is flush with the upward facing surface of the second part. The offset distance may be adjusted according to the dimensions of the second part and other components of the linear drain. The grating may be formed from the same material as the second part or may be formed from another suitable material.

Figure 15:
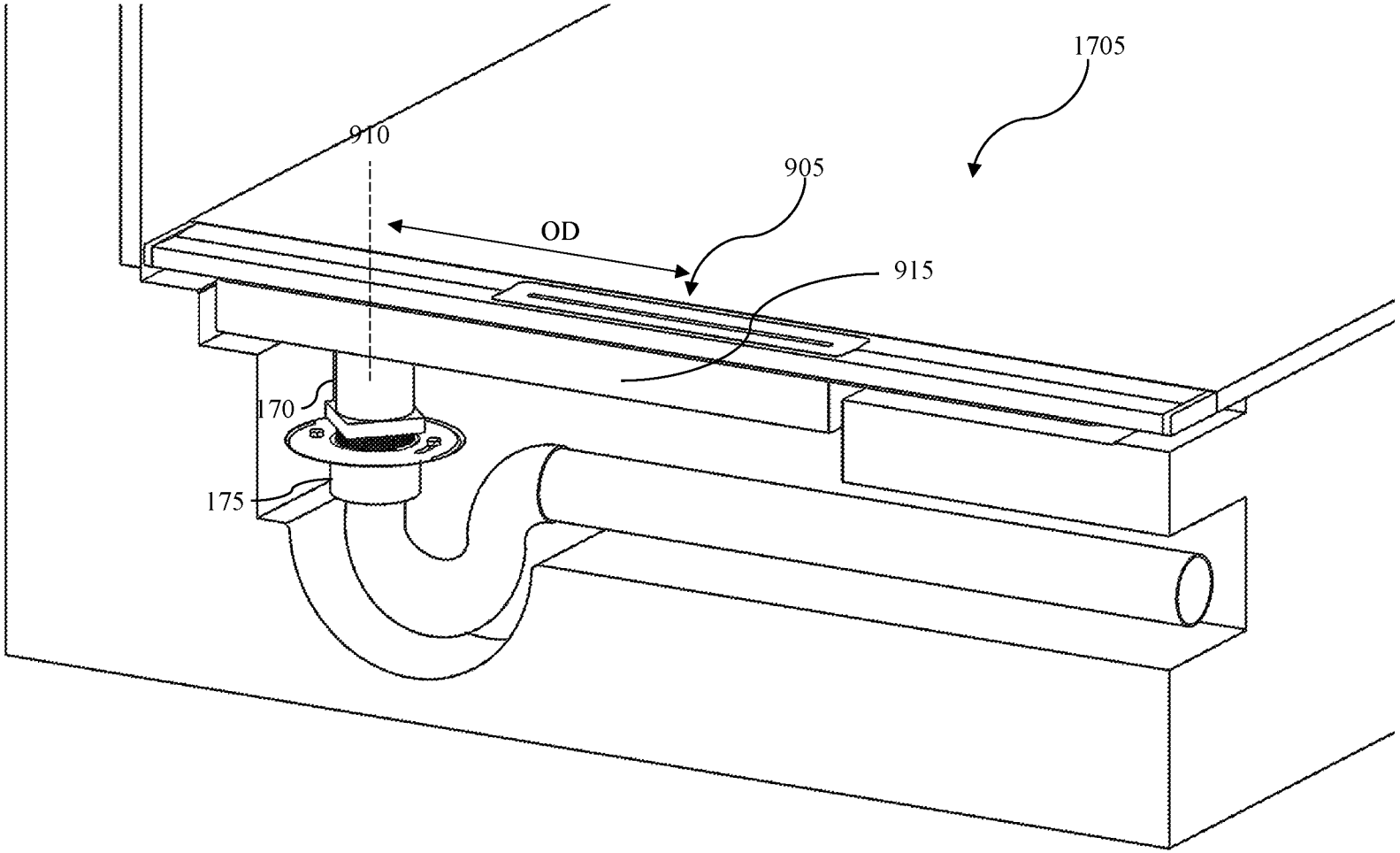
FIG. 15 is a perspective view of a fully assembled linear drain wherein the drain outlet midpoint is located to the left of the centered midpoint location according to an example embodiment of the present invention.
Figure 16:
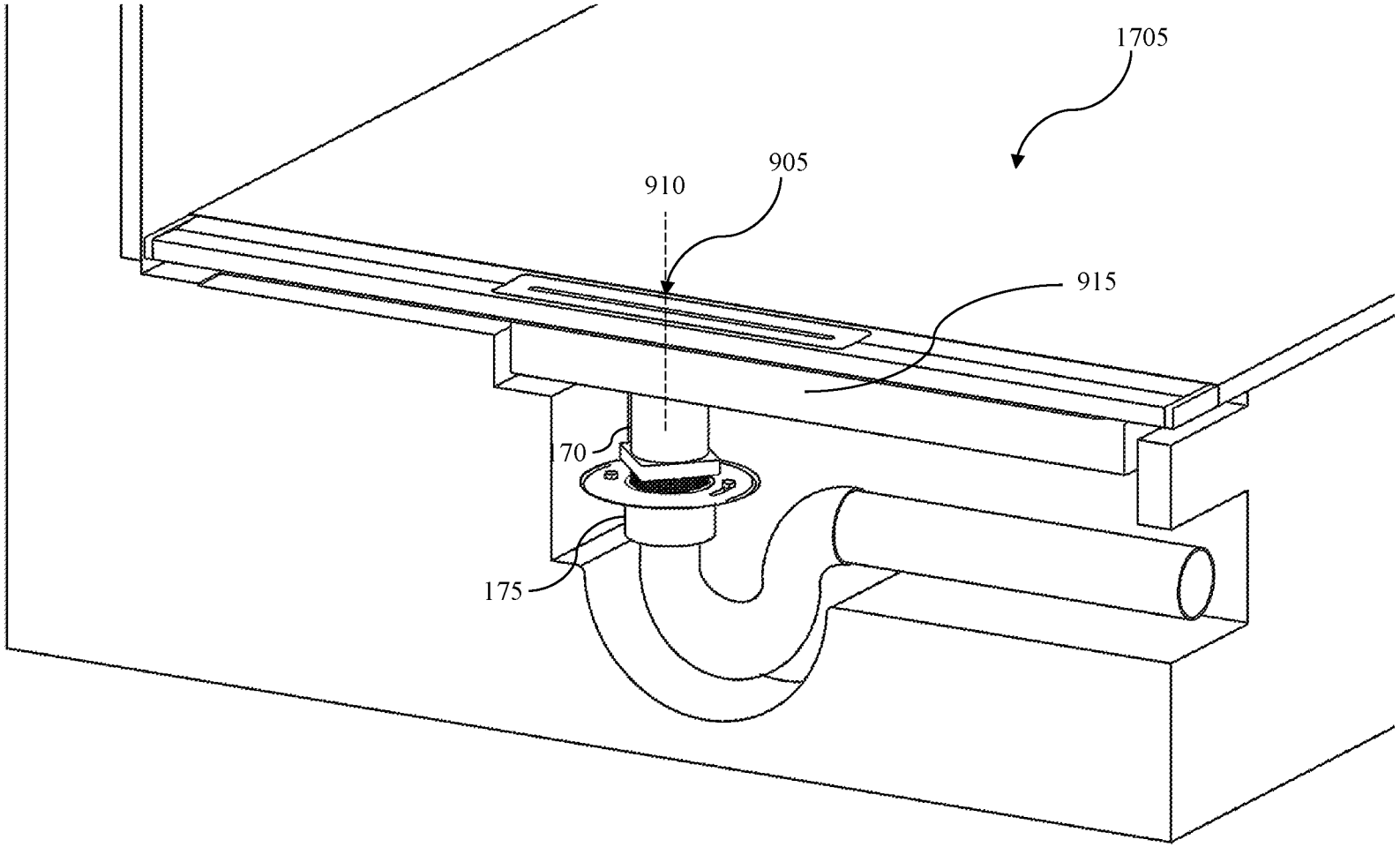
FIG. 16 is a perspective view of a fully assembled linear drain wherein the drain outlet midpoint is located at the centered midpoint location according to an example embodiment of the present invention.
Figure 17:
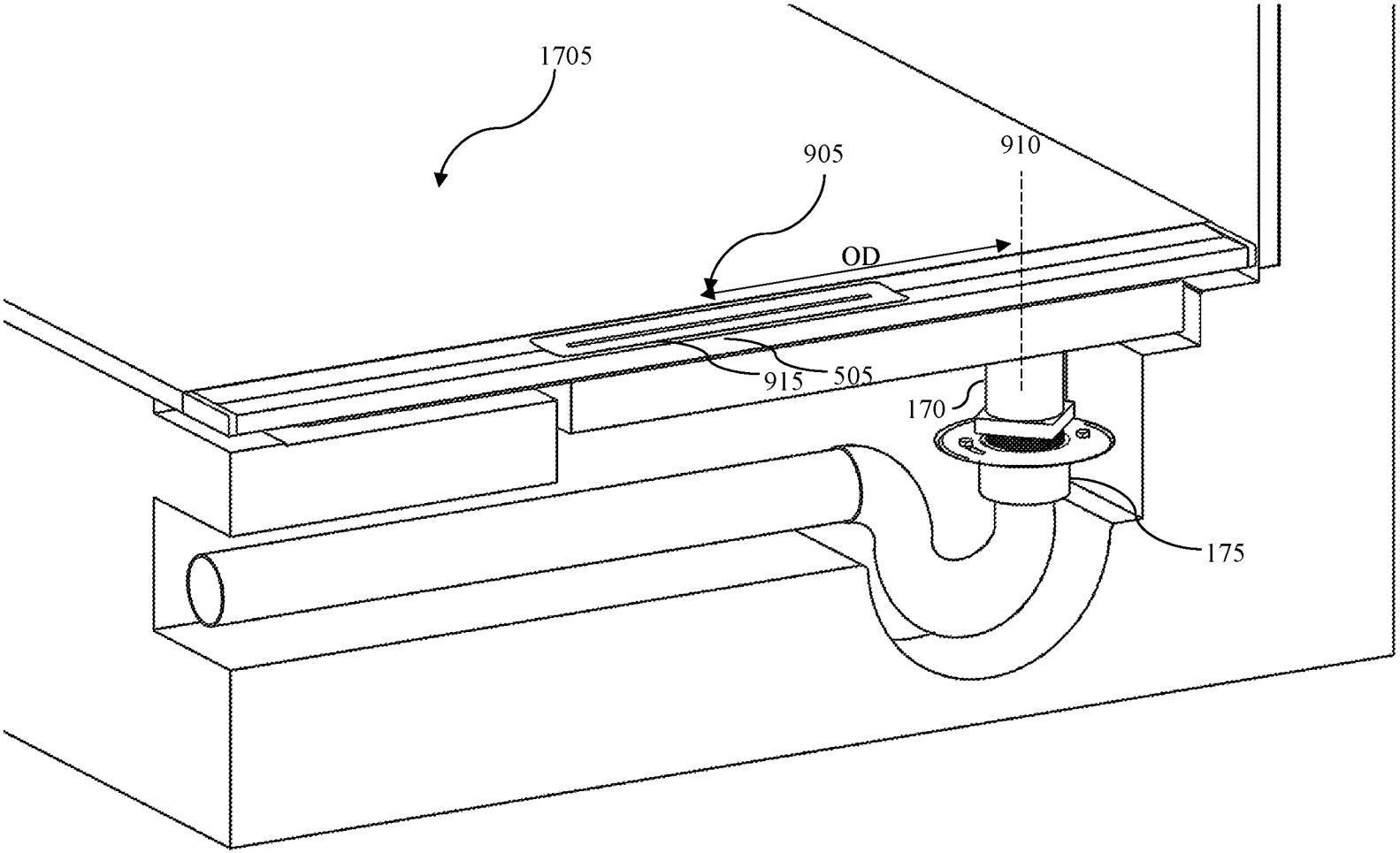
FIG. 17 is a perspective view of a fully assembled linear drain wherein the drain outlet midpoint is located to the right of the centered midpoint location according to an example embodiment of the present invention.

The linear drain further comprises an egress assembly 145 defining a channel 155 that is configured to convey liquid to an egress opening 160 that is offset from a channel midpoint 516 of the channel of the egress assembly and configured to be in communication with the drain outlet (illustrated as 175 in FIGS. 15-17). In the present embodiment, the egress assembly has a substantially rectangular shaped body comprising a base 146, two opposing sidewalls 147, and two opposing end walls 149. The midpoint of the channel or channel midpoint of the egress assembly is the location equidistant between the ends of the channel. It should be appreciated that the egress assembly can have other shapes and such variations are within the spirit and scope of the claimed invention. The egress assembly may be comprised of materials such as galvanized steel or iron, copper, polybutylene, unplasticized polyvinylchloride (PVC), chlorinated polyvinylchloride (CPVC) and polyethylene (PE) to increase corrosion resistance to specific environments, enhance oxidation resistance, and impart special characteristics.

The channel 155 of the egress assembly is formed along the inner surface of the egress assembly and has an opening. The bottom base of the channel has a substantially planar surface configured to direct liquid to at least one egress opening. In another embodiment (not shown), the base of the channel has a sloped upward facing surface configured to direct liquid to at least one egress opening. It should be appreciated that the channel can have other shapes and dimensions, and such variations are within the spirit and scope of the claimed invention. As discussed in more detail below, the egress opening is offset from a channel midpoint 516 and configured to be in communication with the drain outlet 175, thereby providing a centered drain without the need for additional adapters, as shown in FIGS. 15-17. In the present embodiment, the egress opening has a circular shaped circumference and is offset from the channel midpoint on the egress assembly base. It should be appreciated that the egress opening can have other shapes and such variations are within the spirit and scope of the claimed invention. The drain outlet may be attached to sewer or other drain systems such that fluids and other items may be moved to a remote location.

A strainer 165 is removably mounted to a shallow annular depression 163 on the upward facing side of the egress opening to prevent unwanted debris and foreign objects from going down the drain. In the present embodiment, the strainer has a hollow cylindrical shaped body comprising an open top end and a closed bottom end. The open top end has an outwardly extending annular flange 168 configured to rest on the shallow annular depression on the upward facing side of the egress opening. A plurality of evenly-spaced and sized circular holes are located throughout the strainer to catch unwanted debris and foreign objects without blocking fluid drainage. The strainer may be comprised of materials such as galvanized steel or iron, copper, polybutylene, unplasticized polyvinylchloride (PVC), chlorinated polyvinylchloride (CPVC) and polyethylene (PE) to increase corrosion resistance to specific environments, enhance oxidation resistance, and impart special characteristics.

A tubular shaped body 170 attached to the egress opening is configured to attach to the drain outlet 175 or drain system and sewer system. In the present embodiment, the tubular shaped body has a hollow cylindrical shaped body comprising an open top end and an open bottom end. It should be appreciated that other shapes and sizes may also be used and are within the spirit and scope of the present invention. As shown in FIGS. 15-17, the top end of the tubular shaped body 170 is attached to the downward facing side of the egress opening, and the bottom end is attached to the drain outlet 175. The tubular shaped body is configured to allow water to flow out of the egress opening through the drain outlet 175 and into the drainage system and sewage system. The tubular shaped body is offset from a midpoint of the channel. As discussed in more detail below, the offset allows the tubular section or egress of the system to be positioned at several different locations relative to the ingress of the system or openings that allow water or fluid to flow into the drain.

The linear drain further comprises an attaching element for connecting the ingress assembly with the egress assembly such that the ingress assembly can be positioned in numerous different locations relative to the egress opening of the egress assembly. The attaching element may be a variety of different embodiments. In one embodiment, the attaching element includes at least one track element on at least one of the ingress assembly and the egress assembly, at least one receiving element on at least one of the ingress assembly and the egress assembly, and a fastener for attaching the track element to the receiving element. The attaching element is configured such that an ingress assembly midpoint of the ingress assembly is configured to be positioned in a plurality of different final locations relative to the egress opening when the linear drain is in a fully assembled configuration thereby providing a centered drain, as shown in FIGS. 15-17. In one embodiment, the attaching element can include screws, bolts, welds, pins, clamps, brackets, magnets, male-female interference-type connections, cable ties, waterproof adhesives, or any other suitable method known in the art, and such variations are within the spirit and scope of the claimed invention.

Figure 5:
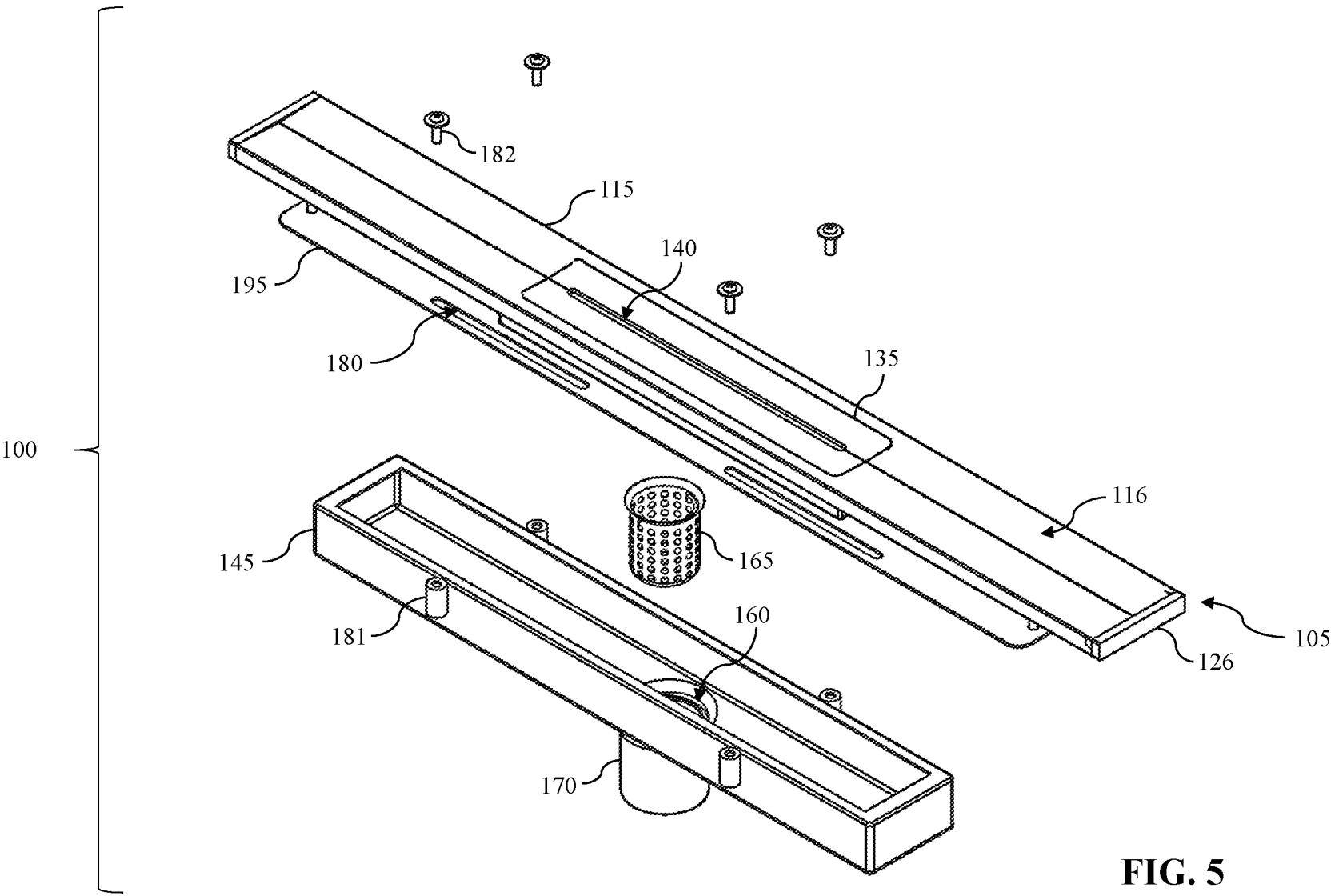
FIG. 5 is a partially exploded top perspective view of an attaching element configured on a linear drain according to an example embodiment of the present invention.

FIGS. 1-7B illustrates another embodiment of an attaching element. Referring to FIG. 5. FIG. 5 is a partially exploded top perspective view of on embodiment of an attaching element of the present invention. In this embodiment, the track element 180 may be defined by at least one slot longitudinally orientated on at least one of the ingress assembly and the egress assembly. In the present embodiment, the track element includes a pair of elongated rectangular shaped slots located lengthwise on each side of the ingress assembly. It should be appreciated that the slots can have a variety of cross-sectional shapes and configurations, and such variations are within the spirit and scope of the claimed invention. The receiving element 181 may be defined by a threaded boss or body having a cavity wherein the cavity walls have threads that are configured for receiving a fastener 182, on at least one of the ingress assembly and the egress assembly, wherein each threaded boss is configured to align with a slot such that fastener 182 is configured to be in the slot and be received by the threaded boss such that the first part of the ingress assembly attaches with the egress assembly when in the fully assembled configuration. In the present embodiment, the receiving element includes a pair of tubular shaped bodies having a threaded interior (not shown) integrated on each outer sidewall of the egress assembly for receiving the fastener therethrough. In this embodiment, the fastener may be a threaded both that is configured to be mated with the threaded interior of the tubular shaped bodies of the receiving element. It should be appreciated that the receiving element member can have other shapes, dimensions, and locations, and such variations are within the spirit and scope of the claimed invention.

Figure 6A:
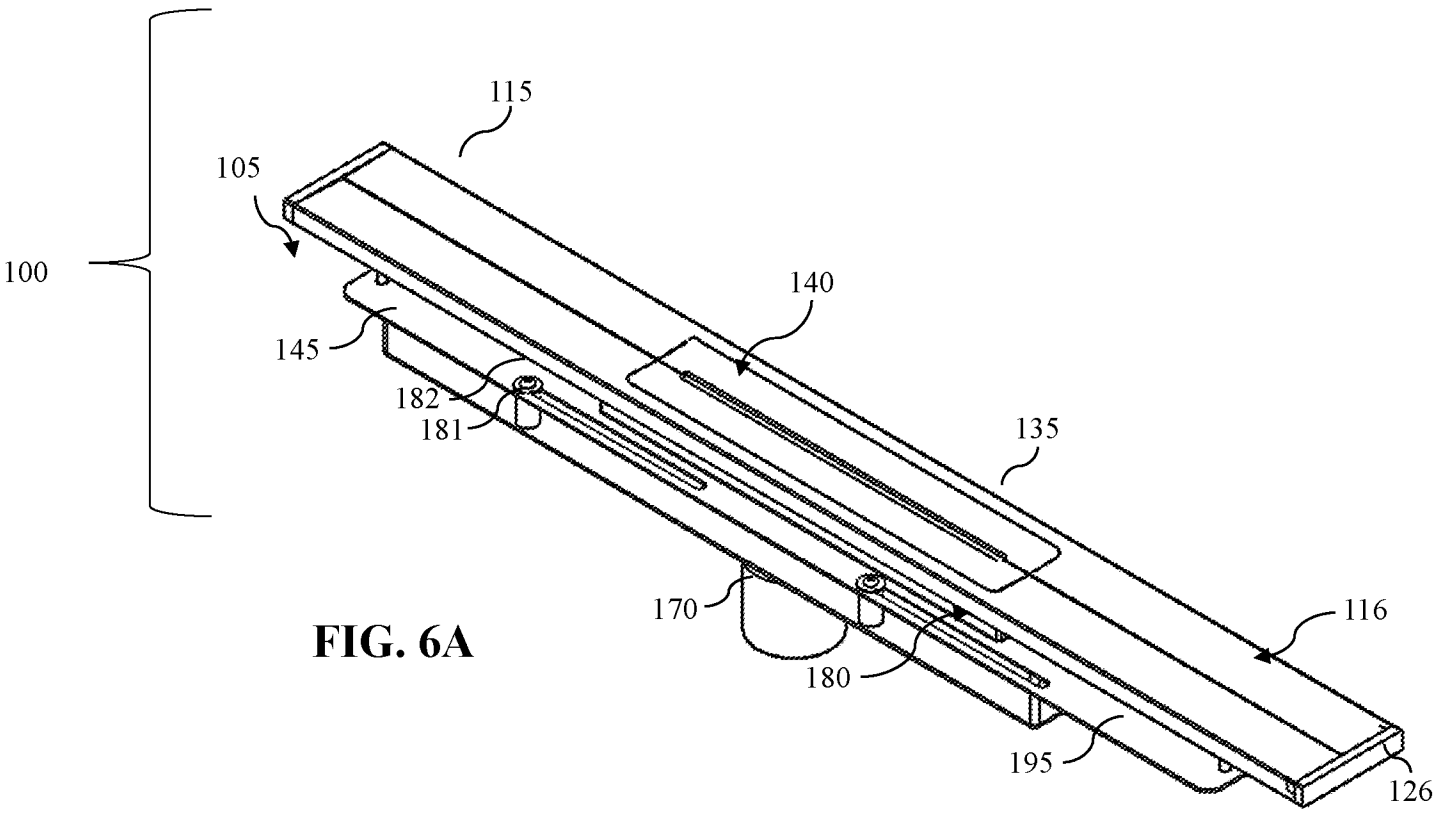
FIG. 6A is a top perspective, partially exploded, view of a linear drain wherein the egress assembly is in a first position relative to the ingress assembly according to an example embodiment of the present invention.
Figure 6B:
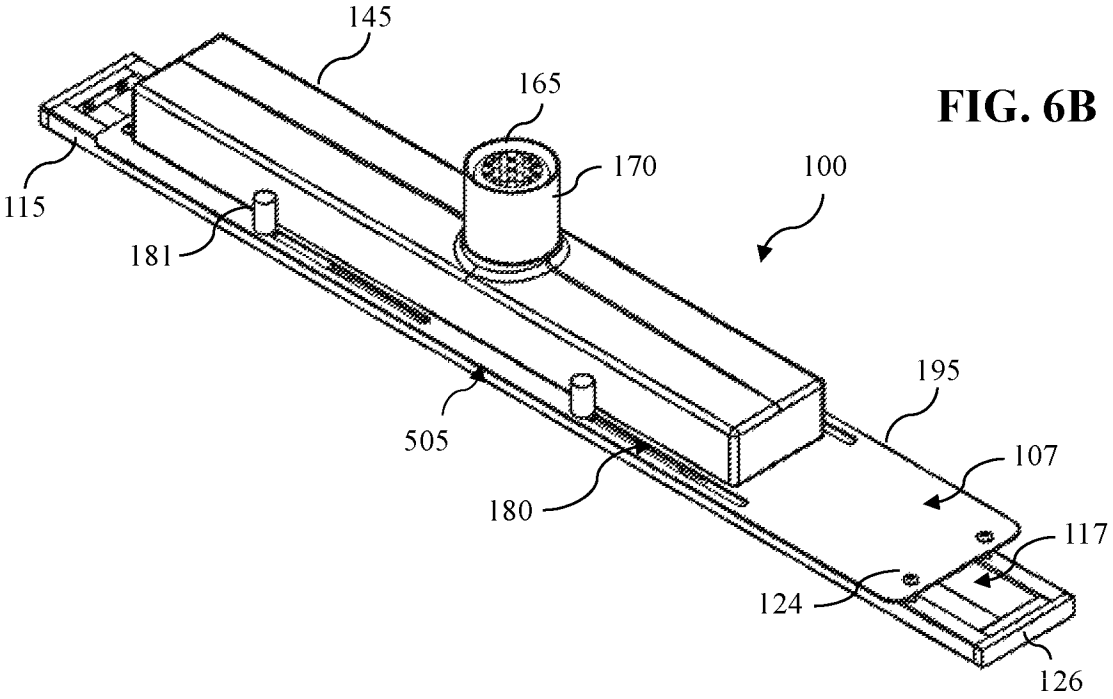
FIG. 6B is a bottom perspective view of a linear drain wherein the egress assembly is in a first position relative to the ingress assembly according to an example embodiment of the present invention.
Figure 7B:
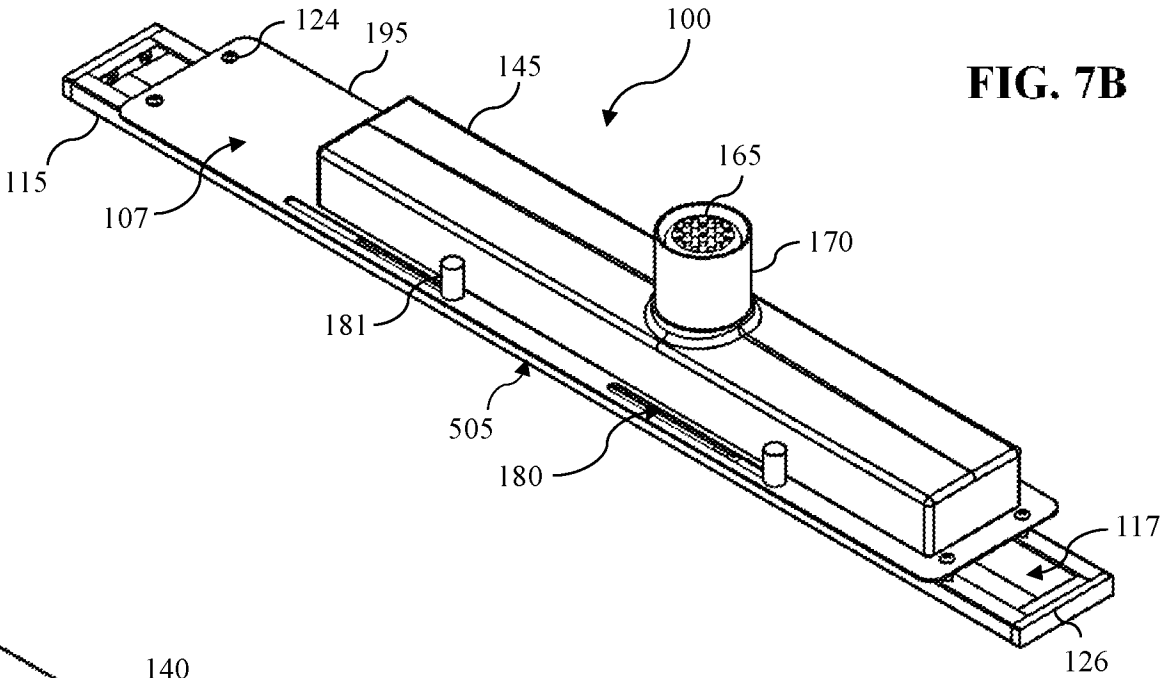
FIG. 7B is a bottom perspective view of a linear drain wherein the egress assembly is in a second position relative to the ingress assembly according to an example embodiment of the present invention.
Figure 7A:
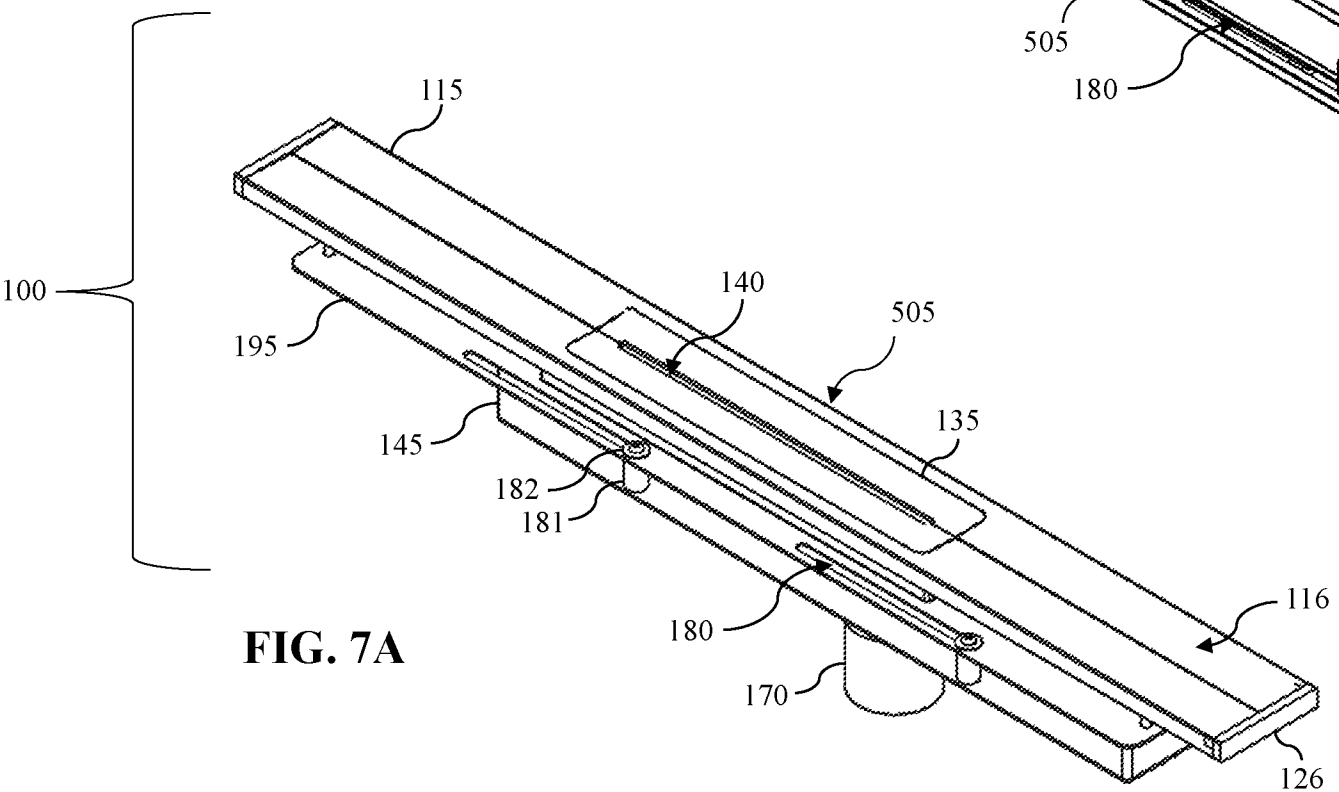
FIG. 7A is a top perspective, partially exploded, view of a linear drain wherein the egress assembly is in a second position relative to the ingress assembly according to an example embodiment of the present invention.

FIGS. 6A and 6B are top and bottom perspective views, respectively, of a linear drain utilizing the attaching element shown in FIG. 5, wherein the egress assembly is in a first position relative to the ingress assembly. In the first position, the egress assembly is positioned such that the receiving elements that are affixed to the egress assembly proximate to a first end of the track element. FIGS. 7A and 7B are top and bottom perspective views, respectively, of a linear drain utilizing the attaching element shown in FIG. 5, wherein the egress assembly is in a second position relative to the ingress assembly. In the second position, the egress assembly is positioned such that the receiving elements that are affixed to the egress assembly proximate to a second end of the track element. In this position, the tubular shaped body, or egress of the drain is configured to be in communication with a drain outlet that is located to the right relative to the midpoint 505 of the ingress assembly. FIGS. 6A-7B illustrates that the ingress assembly midpoint 505 of the ingress assembly can be attached in a variety of different final locations relative to the egress opening 160 when the centered drain is in a fully assembled configuration. The ingress assembly midpoint is the location equidistant to the ends of the ingress assembly. It is also understood that the using the track elements the egress assembly a multitude of locations relative different final locations relative to the egress opening when the centered drain is in a fully assembled configuration.

Figure 8:
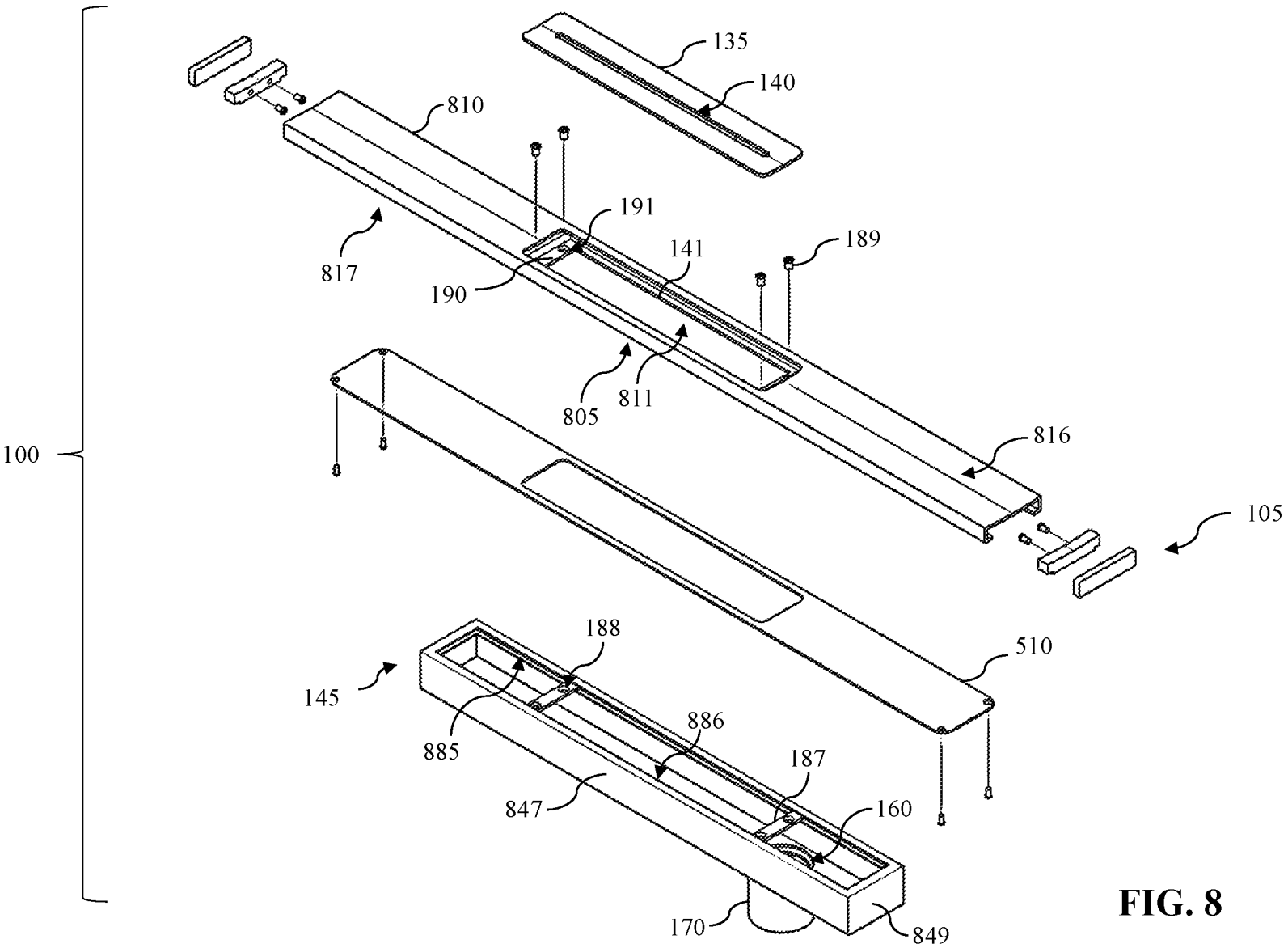
FIG. 8 is an exploded top perspective view of a linear drain according to an example embodiment of the present invention.
Figure 9A:
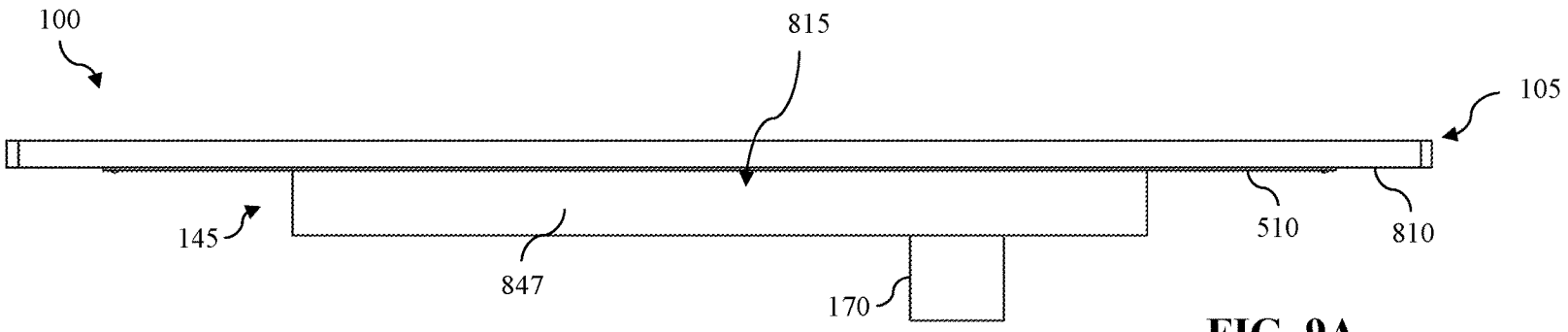
FIG. 9A is a front view of a linear drain according to an example embodiment of the present invention.
Figure 9B:
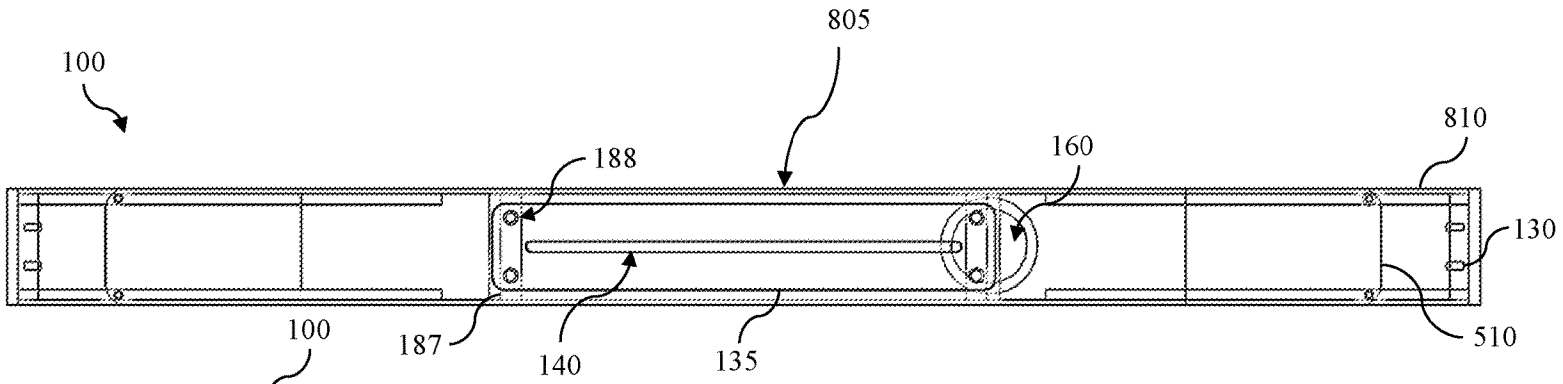
FIG. 9B is a top view of a linear drain according to an example embodiment of the present invention.
Figure 9C:
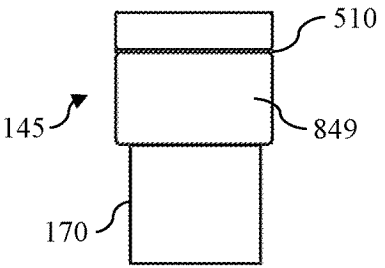
FIG. 9C is a side view of a linear drain according to an example embodiment of the present invention.

FIGS. 8-11 illustrate a linear drain for providing a centered drain opening without moving a drain outlet utilizing another embodiment of an attaching element of the present invention. FIG. 8 is an exploded top perspective view of a linear drain utilizing another embodiment of an attaching element. FIGS. 9A, 9B, and 9C are front, top and side views, respectively, of the fully assembled linear drain utilizing another embodiment of an attaching element. FIGS. 8-11 illustrate that the ingress assembly 105 includes an elongated shaped body 810 defining an ingress opening 811. The elongated rectangular shaped body comprising an upward facing side 816 and a downward facing side 817. The upward facing side of the second part of the ingress assembly has a substantially planar surface to convey fluid toward at least one ingress opening. The downward facing side of the ingress assembly is configured to attach to the egress assembly so that fluid may move through the ingress assembly to the channel of the egress assembly 886 as described more fully below.

FIGS. 8-11 illustrate another embodiment of an attaching element for attaching an ingress assembly to the egress assembly, wherein the attaching element includes a track element, a receiving element and a fastening element or fastener. In the embodiment illustrated in FIGS. 8-11, the track element comprises a first track 885 on a first side of the egress assembly, and a second track 886 on a second side of the ingress assembly. The second track opposes the first track. In the present embodiment, the first track is defined by a rectangular channel located on the inner surface of the first sidewall of the egress assembly, and the second track is defined by a rectangular channel located on the inner surface of the second sidewall of the egress assembly. However, it is understood that the first and second tracks may also be included in other locations.

Figure 10:
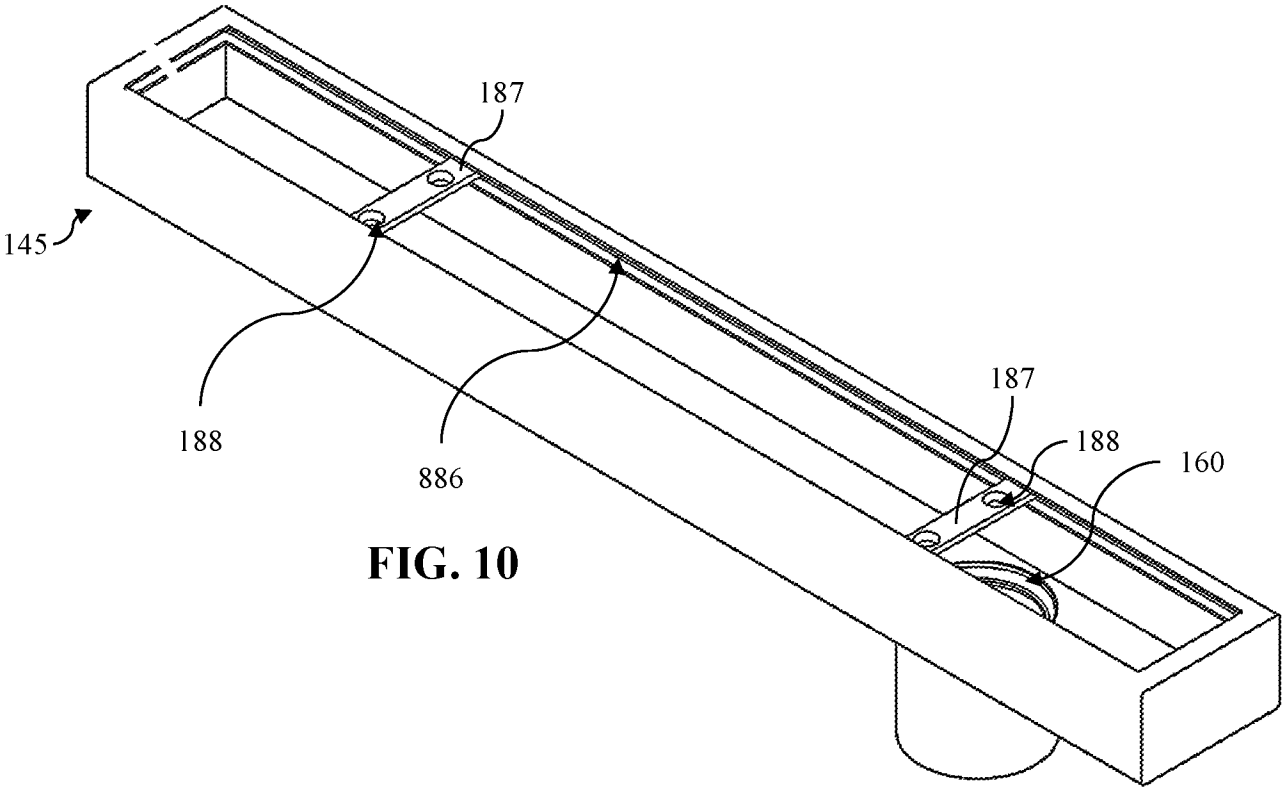
FIG. 10 is a top perspective view of an attaching element for connecting the ingress assembly with the egress assembly according to an example embodiment of the present invention.

FIG. 10 is a top perspective view of a spanning member 187 configured on the egress assembly 145 such that the ends of the spanning member are received by the first and second tracks of the egress assembly. In this embodiment, the linear drain further comprises an egress assembly 145 defining a channel 855 that is configured to convey liquid to an egress opening 160 that is offset from a channel midpoint 815 of the channel and configured to be in communication with the drain outlet (illustrated as 175 in FIGS. 15-17). The midpoint of the channel is the location of the channel equidistant from each of the ends of the channel.

In the present embodiment, the egress assembly has a substantially rectangular shaped body comprising a base 846, two opposing sidewalls 847, and two opposing end walls 849. The midpoint of the channel is the location equidistant between the ends of the channel. It should be appreciated that the egress assembly can have other shapes and such variations are within the spirit and scope of the claimed invention. The egress assembly may be comprised of materials such as galvanized steel or iron, copper, polybutylene, plasticized polyvinylchloride (PVC), chlorinated polyvinylchloride (CPVC) and polyethylene (PE) to increase corrosion resistance to specific environments, enhance oxidation resistance, and impart special characteristics.

A spanning member 187 is configured to span the channel from the first track to the second track such that the ends of the spanning member are received within the first track and the second track such that the spanning member translates within the first track and second track. The spanning member is configured to be moved by the user to the position required so that the opening of the ingress assembly may be positioned to the correct position and then attached to the spanning member (further explained below). In the present embodiment, the spanning member comprises a substantially planar rectangular shaped body, however, it should be appreciated that the spanning member can have other shapes and dimensions, and such variations are within the spirit and scope of the claimed invention. The spanning member has a first end and a second end and includes at least one spanning member opening 188 between the first end and second end. The spanning member opening is configured for engaging with a fastener 189 so that the fastener may attach the spanning member to the ingress assembly. In the present embodiment, the spanning member includes a pair of spanning member openings defined by circular holes formed therethrough. It should be appreciated that the spanning member opening can have a variety of cross-sectional shapes and configurations, and such variations are within the spirit and scope of the claimed invention.

Figure 11:
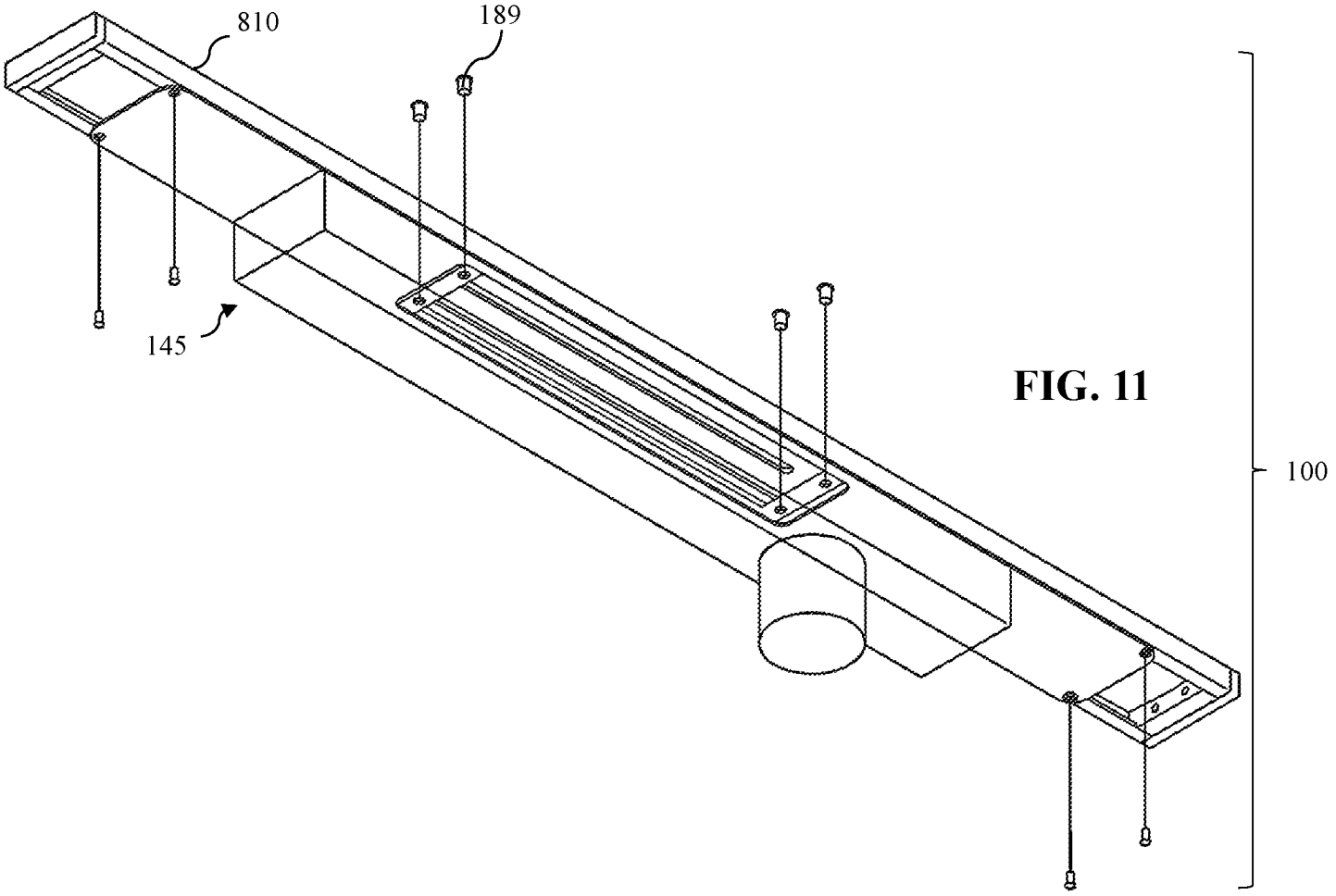
FIG. 11 is a partially exploded bottom perspective view of a linear drain according to an example embodiment of the present invention.

In the embodiment illustrated in FIGS. 8-13, the receiving element 190 may defined by at least one receiving element opening 191 on the ingress assembly. Each receiving element opening 191 is configured to align with the spanning member opening when the spanning member is correctly positioned such that the fastener may be received in the receiving element opening and be received by the spanning member opening such that the ingress assembly is attached with the egress assembly when in the fully assembled configuration, as shown in FIG. 11. In the present embodiment, the receiving element comprises a pair of circular shaped holes or openings 191 located widthwise on each side of a flanged portion of the opening. The diameter of the receiving element opening is approximately equal to the diameter of the spanning member opening for receiving a fastener therethrough to attach the ingress assembly with the egress assembly. It should be appreciated that the receiving element opening can have a variety of cross-sectional shapes and configurations, and such variations are within the spirit and scope of the claimed invention. It is also understood that a gasket 510 may also be used for sealing purposes. In operation a user would determine the position of the ingress assembly relative to the egress assembly, then position the spanning member openings 188 to align with openings 191 of the receiving element, then use a fastener to attach the spanning member with the receiving member and to prevent translation of the egress assembly relative to the ingress assembly. In this embodiment, the fastener may be a threaded both configured to mate with threads along the inward facing walls of the spanning member openings. In other embodiments, the fastener may include a threaded bolt configured to pass through the spanning member openings and secured to the spanning member by a nut. However, other means of attaching the fastener to the spanning member may be used and are within the spirit and scope of the present invention.

Figures 12, 13:
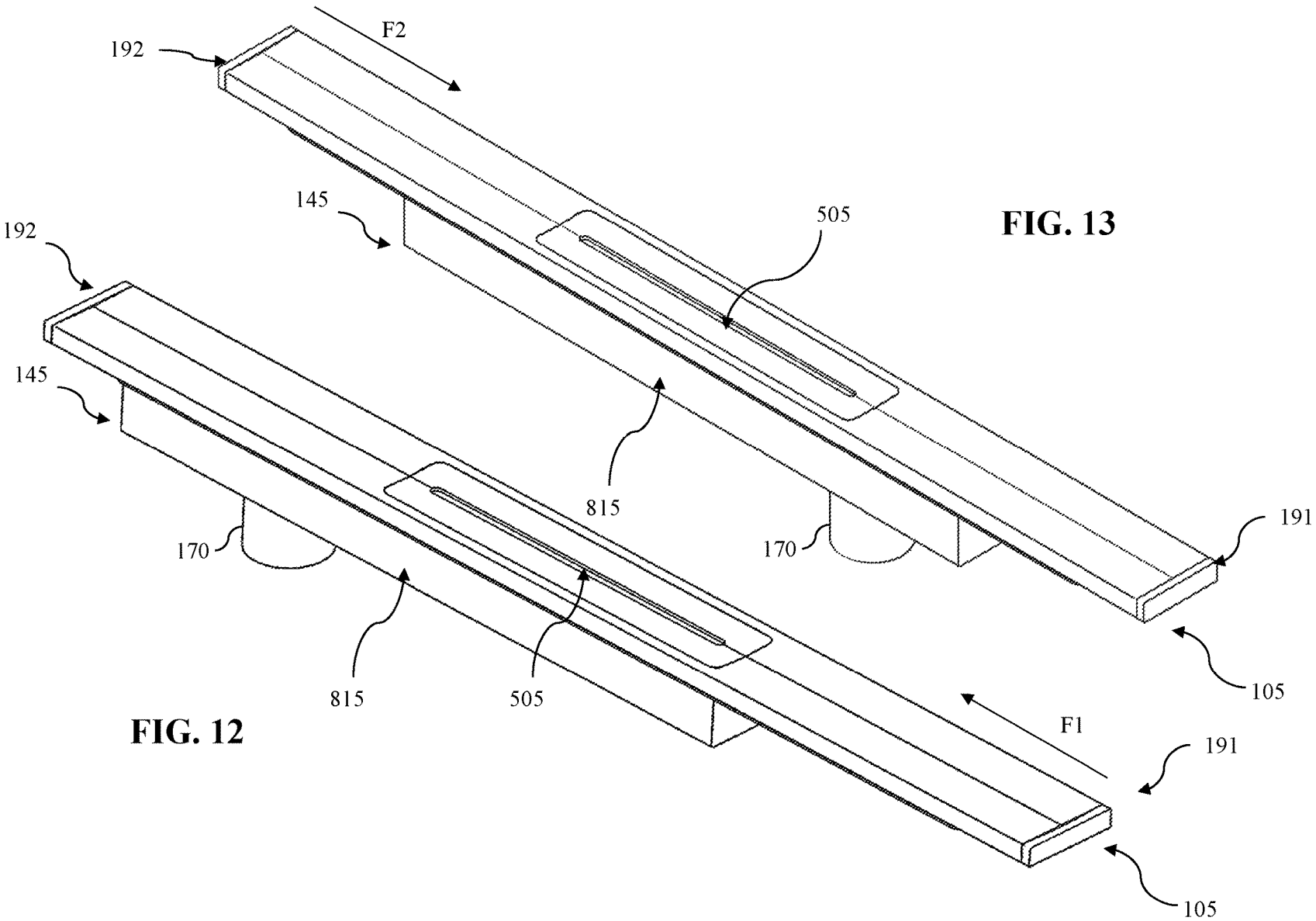
FIG. 12 is a top perspective view of a linear drain wherein the egress assembly is in a first position relative to the ingress assembly according to an example embodiment of the present invention.
FIG. 13 is a top perspective view of a linear drain wherein the egress assembly is in a second position relative to the ingress assembly according to an example embodiment of the present invention.

FIG. 12 is a top perspective view of a linear drain utilizing the attaching element shown in FIGS. 8-11, wherein the egress assembly 145 is in a first position relative to the ingress assembly 105. In the first position, the egress assembly 145 is positioned such that the egress opening is to the left of the ingress opening. In this position, the tubular shaped body, or egress of the drain is configured to be in communication with a drain outlet that is located to the left relative to the midpoint 505 of the ingress assembly. In operation, a user will apply force (in the direction of line F1) to an end 191 of the egress assembly to slide the spanning members along the first and second track element to another desired position if necessary. The attaching element is used to secure the ingress assembly relative to the egress assembly so that the ingress assembly does not move relative to the egress assembly.

FIG. 13 is a top perspective view of a linear drain utilizing the attaching element shown in FIGS. 8-11, wherein the egress assembly is in a second position relative to the ingress assembly. In the second position, the egress assembly 145 is positioned such that the egress opening is to the right of the ingress opening, or at least a substantial portion thereof. In operation, a user will apply force (in the direction of line F2) to an end 192 of the egress assembly to slide the spanning members along the first and second track element to another position. In this position, the tubular shaped body, or egress of the drain is configured to be in communication with a drain outlet that is located to the right relative to the midpoint 505 of the ingress assembly. FIGS. 12 and 13 illustrate the drain can be configured to attach to a drain outlet at a plurality of different locations relative to the center point 505 of the ingress assembly.

Figure 14:
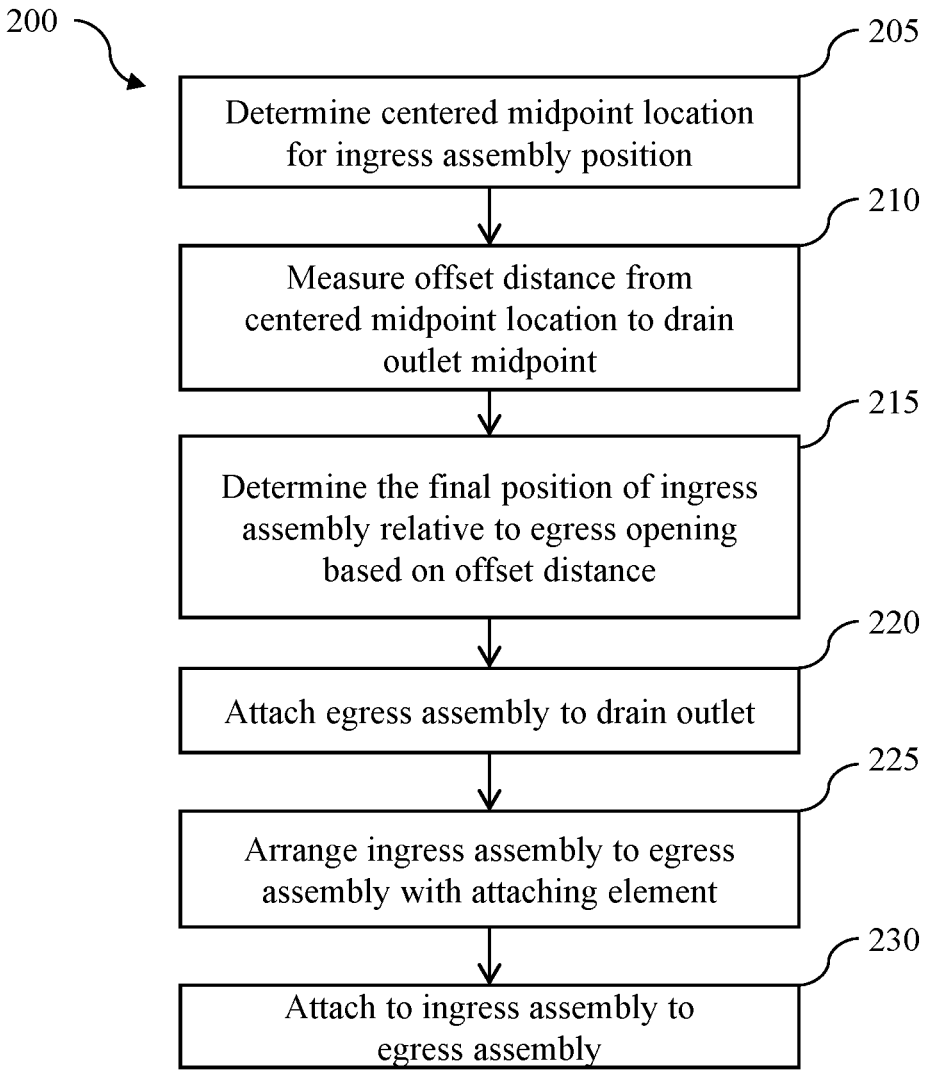
FIG. 14 is a flowchart illustrating steps related to the process of installing a linear drain, according to an example embodiment of the present invention.

FIG. 14 is a flowchart illustrating steps related to the process 200 for installing on a drain outlet, without moving the drain outlet, a centered linear drain, wherein the drain outlet is offset from an ingress assembly midpoint of an ingress assembly, according to an example embodiment. The sequence of steps depicted is for illustrative purposes only and is not meant to limit the method in any way as it is understood that the steps may proceed in a different logical order, additional or intervening steps may be included, or described steps may be divided into multiple steps, without detracting from the invention.

The process begins with step 205, determining a centered midpoint location 905 where the ingress assembly midpoint of the ingress assembly will be positioned when the centered linear drain is in a fully assembled configuration. This centered midpoint location will be used to provide a centered drain. As described above, the linear drain includes an ingress assembly defining at least one ingress opening. In an example embodiment, the ingress assembly has a substantially planar rectangular shaped body with rounded corners comprising an upward facing side and a downward facing side, and the ingress opening is located on the center of the ingress assembly and comprises an elongated rectangular-shaped opening having a predetermined length and width such that fluid flows through the ingress opening and into the egress assembly channel. In step 205, the midpoint location 905 is illustrated in FIGS. 15-17 that illustrates the location that the user desires to have the ingress opening positioned.

After the user has determined the centered midpoint, at step 210, the process includes measuring an offset distance (represented by arrowed line OD) from the centered midpoint location 905 to a drain outlet midpoint 910 of the drain outlet 175. The offset distance OD between the centered midpoint location 905 and the midpoint 910 of the drain outlet must be less than eight inches to ensure proper installation and drainage. The offset distance will be used to configure the ingress assembly relative to the egress assembly. It is understood that in the present embodiment the multitude of final locations may include any position that the ingress assembly midpoint of the ingress assembly is positioned relative to the egress opening as long as the offset distance OD between the centered midpoint location 905 and the midpoint 910 of the drain outlet is less than eight inches. However, it is understood that in other embodiments, longer dimensions may be used. FIGS. 15-17 illustrate three different offset distances because of three different locations of the drain outlet. FIGS. 15-17 illustrate that a centered drain be provided by the linear drain without adapters while having multiple locations where the drain outlet 175 is located. To ensure that the offset distance is less than eight inches, the operator must measure to ensure that the offset distance (OD) is less than eight inches prior to determining the final configuration of the ingress assembly relative to the egress opening. However, for larger applications larger dimensions may be used.

Next, at step 215, the process includes determining a final configuration of the ingress assembly relative to an egress opening of an egress assembly based upon the offset distance OD. The user will use the offset distance to arrange the position of the ingress assembly relative to the ingress assembly. In operation a user will use the offset distance OD to determine how to configure the ingress assembly relative to the egress assembly. FIGS. 15-17 illustrate a centered drain provided by the linear drain, which is arranged and positioned and attached to the drain outlet below the flooring or floor 1705. FIG. 15 is a perspective view of a fully assembled linear drain wherein the ingress assembly and the egress assembly are arranged such that the drain outlet midpoint of the drain outlet 175 is located to the left of the centered midpoint 905 location according to an example embodiment of the present invention. In this configuration, the drain outlet midpoint of the drain outlet 175 in the fully assembled configuration is located to the left relative to the centered midpoint location and the longer portion 910 of the channel is located to the right of the drain outlet 175. FIG. 15 illustrates that the user will position the longer portion of the channel facing right if the drain outlet midpoint of the drain outlet 175 in the fully assembled configuration is to be located to the left relative to the centered midpoint location 905. The user will use the attaching element to connect the ingress assembly to the egress assembly such that the ingress assembly does not move relative to the egress assembly and such that fluid passes through the ingress assembly and into the egress opening. In the embodiment illustrated in FIGS. 1-7B, the using the attaching element to connect the ingress assembly with the egress assembly means aligning the slots 180 over the threaded bosses 181 such that the at least one fastener 182 is configured to be in the slot and be received by the threaded boss. Next the user will attach the fastener 182 to the threaded boss. Next the user will use fasteners 124 to attach the first part of the ingress assembly with the second part of the ingress assembly. The fastener may include screws, bolts, threaded bolts, nuts welds, pins, clamps, brackets, magnets, male-female interference-type connections, cable ties, waterproof adhesives, or any other suitable method known in the art, and such variations are within the spirit and scope of the claimed invention.

By way of another example, the embodiment illustrated in FIGS. 8-11, to use the attaching element to attach the ingress assembly with the egress assembly, the user would position the spanning member opening 188 to align with receiving element openings 191, then use a fastener 189 to secure the ingress assembly to the egress assembly. The fastener 189 may include screws, bolts, threaded bolts, nuts welds, pins, clamps, brackets, magnets, male-female interference-type connections, cable ties, waterproof adhesives, or any other suitable method known in the art, and such variations are within the spirit and scope of the claimed invention.

FIG. 16 is a perspective view of a fully assembled linear drain wherein the ingress assembly and the egress assembly are arranged such that the drain outlet midpoint 910 is located at the centered midpoint location 905 according to an example embodiment of the present invention. In this configuration, if the drain outlet midpoint of the drain outlet 175 in the fully assembled configuration is located at the centered midpoint location, then the longer portion 915 of the channel can be located either to the left or to the right of the drain outlet. FIG. 16 illustrates that the user may position the longer portion 915 of the channel facing either left or facing right if the drain outlet midpoint in the fully assembled configuration is to be located at the midpoint location having an offset distance that is zero or not offset from the midpoint 905. The user will use the attaching element to connect the ingress assembly to the egress assembly such that the ingress assembly does not move relative to the egress assembly and such that fluid passes through the ingress assembly and into the egress opening.

FIG. 17 is a perspective view of a fully assembled linear drain wherein the ingress assembly and the egress assembly are arranged such that the drain outlet midpoint 910 of the drain outlet 175 is located to the right of the centered midpoint location 905 according to an example embodiment of the present invention. In this configuration, the drain outlet midpoint in the fully assembled configuration is located to the right relative to the centered midpoint location and the longer portion 915 of the channel is located to the left of the drain outlet. It is understood that the various embodiments of the attaching elements along with the egress opening being offset from a channel midpoint of the channel allows the user to easily position the midpoint of the ingress assembly in a plurality of different final locations relative to the egress opening when the centered drain is in a fully assembled configuration. FIG. 17 illustrates that a user will have to position the longer portion 915 of the channel facing left if the drain outlet midpoint of the drain outlet 175 in the fully assembled configuration is to be located to the right relative to the centered midpoint location 905. The user will use the attaching element to connect the ingress assembly to the egress assembly such that the ingress assembly does not move relative to the egress assembly and such that fluid passes through the ingress assembly and into the egress opening.

At step 220, the process includes attaching the egress assembly to the drain outlet such that the egress opening is in fluid communication with the drain outlet and such that in the fully assembled configuration the ingress assembly midpoint can be positioned at the desired centered midpoint location 905. FIGS. 15-17 illustrate the egress opening attached to the drain outlet 175. A tubular shaped body 170 is attached to the downward facing side of the egress opening to secure the egress assembly to the drain outlet. In an example embodiment, the tubular shaped body has a hollow cylindrical shaped body comprising an open top end and an open bottom end. As shown in FIGS. 15-17, the top end of the tubular shaped body is attached to the downward facing side of the egress opening, and the bottom end is attached to the drain outlet. The tubular shaped body is configured to allow water to flow out of the egress opening and into the drain outlet. The tubular shaped body may be attached using adhesives or other types of fasteners.

After the egress assembly is attached to the drain outlet, a strainer is removably mounted to a shallow annular depression on the upward facing side of the egress opening to prevent unwanted debris and foreign objects from going down the drain. The open top end has an outwardly extending annular flange configured to rest on the shallow annular depression on the upward facing side of the egress opening. A plurality of evenly-spaced and sized circular holes are located throughout the strainer to catch unwanted debris and foreign objects without blocking fluid drainage. At this stage water may enter into the egress opening and flow into the drainage or sewage systems.

At step 225, the process includes arranging the ingress assembly on the egress assembly such that the ingress assembly midpoint is positioned at the centered midpoint location 905 and is the offset distance OD away from an egress opening midpoint such that the drain outlet 175 may be attached to the tubular shaped body 170 and aligns with the egress opening. In the present embodiment the egress opening midpoint is the same as the midpoint of the tubular shaped body. FIGS. 15-17 illustrate that the ingress assembly midpoint is positioned at the centered midpoint location 905 at the offset distance away from the egress opening midpoint. The egress opening midpoint is the midpoint between the ends of the egress opening.

At step 230, the process includes attaching the ingress assembly to the egress assembly with the attaching element. It is understood that this step may occur before or after the egress assembly is attached to the drain outlet depending on the preference of the user and other factor. Step 230 includes attaching the ingress assembly to the egress assembly in a variety of different methods, including the methods to attach the ingress assemblies with the egress assemblies illustrated above. For the embodiments defined above, the method further includes using a fastener of the attaching element to fasten a track element of the attaching element with a receiving element of the attaching element. As described above, the linear drain further comprises an attaching element for connecting the ingress assembly with the egress assembly. In one embodiment, the attaching element comprises at least one track element on at least one of the ingress assembly and the egress assembly, at least one receiving element on at least one of the ingress assembly and the egress assembly, and a fastener for attaching the track element to the receiving element. The attaching element is configured such that an ingress assembly midpoint of the ingress assembly is configured to be positioned in a plurality of different final locations relative to the egress opening when the centered drain is in a fully assembled configuration, as shown in FIGS. 15-17.

Referring to FIGS. 1-7B, in an example embodiment of an attaching element of the present invention, the track element is defined by at least one slot longitudinally orientated on at least one of the ingress assembly and the egress assembly. The receiving element is defined by a threaded boss on at least one of the ingress assembly and the egress assembly, wherein each threaded boss is configured to align with the slot such that the fastener is configured to be in the slot and be received by the threaded boss such that ingress assembly attaches with the egress assembly when in the fully assembled configuration. In order to install the ingress assembly to the egress assembly utilizing this attaching element, at least one slot of the track element must be aligned with at least one threaded boss of the receiving element. After alignment, a fastener is positioned in the slot to be received by the threaded boss and tightened in place. Referring to FIGS. 1-7B, in operation the user will align at least one slot of the track element with at least one threaded boss of the receiving element. Next, the user will the fastener in the slot to be received by the threaded boss to attach the ingress assembly to the egress assembly after the final configuration of the ingress assembly relative to the egress assembly has been determined.

As illustrated in FIGS. 8-13, in another example embodiment of an attaching element of the present invention, the track element comprises a first track on a first side of at least one of the ingress assembly and egress assembly, and a second track on a second side of at least one of the ingress assembly and egress assembly, wherein the second track opposes the first track. A spanning member is configured to span the channel from the first track to the second track such that the spanning member translates within the first track and second track. The spanning member includes at least one spanning member opening configured for engaging with a fastener 189. The receiving element is defined by at least one receiving element opening on at least one of the ingress assembly and the egress assembly, wherein each receiving element is configured to align with the spanning member opening such that the fastener is configured to be in the receiving element opening and be received by the spanning member opening such that the ingress assembly is attached with the egress assembly when in the fully assembled configuration.

In order to install the ingress assembly to the egress assembly utilizing this attaching element, the process begins with determining at least one receiving element opening final position for at least one receiving element opening of the receiving element. Next, at least one spanning member is positioned within at least one track, such that at least one spanning member opening will align in the fully assembled configuration with the at least one receiving element opening final position (as seen and illustrated in FIGS. 9B and 11). Thereafter, the ingress assembly is positioned on top of the egress assembly such that the at least one receiving element opening aligns with the at least one spanning member opening. Lastly, a fastener is positioned in the receiving element opening and spanning member opening and tightened in place. Next, the method further includes attaching a grating having at least one grating opening to the ingress assembly such that the at least the grating opening aligns with the ingress opening such that fluid flows into the channel. After the drain has been installed the operator may use caulking and other sealants to ensure that the drain is sealed and does not allow fluid to move from above the flooring to below the flooring.

It is also worth noting that in all embodiments the ingress assembly 105 has a length that is substantially longer that length of the egress assembly 145. The length of the ingress assembly being substantially longer than the length of the egress assembly combined with the offset of the egress opening being offset from the channel midpoint is important because it allows the ingress assembly to be positioned in a plurality of different final locations relative to the egress opening when the drain is in a fully assembled configuration without moving a drain outlet thereby providing a centered drain. If the length of the ingress assembly is not substantially longer than the length of the egress assembly, then ingress assembly midpoint of the ingress assembly will not be configured to be positioned in enough different final locations relative to the egress opening when the centered drain is in a fully assembled configuration. In one embodiment, the length of the ingress assembly is at least ⅕ longer than the length of the egress assembly. In one embodiment, the length of the ingress assembly is at least ¼ longer than the length of the egress assembly. In one embodiment, the length of the ingress assembly is at least ⅓ longer than the length of the egress assembly. In one embodiment, the length of the ingress assembly is at least ½ longer than the length of the egress assembly. However, other lengths may be used that are within the spirit and scope of the present invention. It is also worth noting that the width of the ingress assembly is not substantially larger than the width of the egress assembly. If the width of the ingress assembly is substantially larger than the width of the egress assembly, then the linear drain would not function correctly.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. A linear drain assembly for providing a centered drain surface ingress opening in a shower stall without moving an existing non-centered drain outlet which is located adjacent a wall of said shower stall, the linear drain assembly comprising:

a fixed elongated ingress body spanning a substantial portion of the length of said wall and having an elongated ingress body longitudinal midpoint, the elongated ingress body comprising an ingress opening area having an ingress opening area longitudinal midpoint and at least one ingress area opening, wherein the ingress opening area longitudinal midpoint is the same as the elongated ingress body longitudinal midpoint, wherein the ingress opening area allows fluid to flow through the elongated ingress body;

a movable elongated egress body of shorter length than said fixed elongated ingress body and comprising an elongated trough defining an elongated channel and having an elongated egress body longitudinal midpoint;

an egress opening at a bottom side of the elongated trough, wherein the elongated channel is capable of conveying liquid to the egress opening, wherein the egress opening comprises an egress opening midpoint that is offset from the egress body longitudinal midpoint by at least ten percent of a full length of the elongated egress body of the channel, wherein the movable elongated egress body is movably positionable such that an axial center of the egress opening is substantially axially aligned with an axial center of the existing non-centered drain outlet, to place the elongated channel in fluid communication with the existing non-centered drain outlet;

and an attaching element for connecting the fixed elongated ingress body to the top of the movable elongated egress body;

wherein, in an assembled configuration, the fixed elongated ingress body is attached to top of the movable elongated egress body by the attaching element such that the ingress opening area is in fluid communication with the egress opening, permitting water draining from the shower stall to flow through the channel and egress opening and into the existing non-centered drain outlet.

2. The linear drain assembly of claim 1, wherein a tubular shaped body is attached to the egress opening.

3. The linear drain assembly of claim 2, wherein the attaching element comprises:

at least one ingress body attachment opening on a lower portion of the fixed elongated ingress body;

at least one track disposed on an upper portion of the movable elongated egress body;

a movable receiving member having a receiving member opening, the movable receiving member engaging the at least one track; and, at least one fastener that is inserted into the receiving member opening and ingress body attachment opening such that the fixed elongated ingress body attaches to the elongated egress body.

* * * * *